US009700487B2

(12) United States Patent
Imai et al.

(10) Patent No.: US 9,700,487 B2
(45) Date of Patent: Jul. 11, 2017

(54) MEDICAL CONTAINER AND METHOD OF MANUFACTURING THE SAME

(71) Applicant: TERUMO KABUSHIKI KAISHA, Shibuya-ku (JP)

(72) Inventors: Masaomi Imai, Kanagawa (JP); Takaaki Hiranuma, Shizuoka (JP)

(73) Assignee: Terumo Kabushiki Kaisha, Shibuya-ku, Tokyo (JP)

( * ) Notice: Subject to any disclaimer, the term of this patent is extended or adjusted under 35 U.S.C. 154(b) by 447 days.

(21) Appl. No.: 14/199,325

(22) Filed: Mar. 6, 2014

(65) Prior Publication Data

US 2014/0183094 A1 Jul. 3, 2014

Related U.S. Application Data

(63) Continuation of application No. PCT/JP2012/071308, filed on Aug. 23, 2012.

(30) Foreign Application Priority Data

Sep. 7, 2011 (JP) ..... 2011-195013

(51) Int. Cl.
*A61J 1/14* (2006.01)
*A61J 1/00* (2006.01)
(Continued)

(52) U.S. Cl.
CPC ..... *A61J 1/1493* (2013.01); *A61J 1/00* (2013.01); *A61J 1/2096* (2013.01); *A61J 1/16* (2013.01);
(Continued)

(58) Field of Classification Search
CPC A61J 1/00; A61J 1/1412; A61J 1/1493; A61J 1/201; A61J 1/2096
See application file for complete search history.

(56) References Cited

U.S. PATENT DOCUMENTS 2,471,852 A * 5/1949 Bau ..... A45D 40/0075 137/614.14
4,131,217 A * 12/1978 Sandegren ..... B65D 83/0094 222/103
(Continued)

FOREIGN PATENT DOCUMENTS

JP 2010-179063 A 8/2010
WO WO 2010/004926 A1 1/2010
(Continued)

OTHER PUBLICATIONS

International Search Report (PCT/ISA/210) mailed on Sep. 25, 2012, by the Japanese Patent Office as the International Searching Authority for International Application No. PCT/JP2012/071308.

*Primary Examiner* — Leslie Deak
*Assistant Examiner* — Kai Weng
(74) *Attorney, Agent, or Firm* — Buchanan Ingersoll & Rooney PC

(57) ABSTRACT

A medical container includes: a container body, a mouth section through which liquid can enter and exit, a proximal-end opening, and a proximal-end edge portion surrounding the proximal-end opening; a plug body that seals the mouth section; a bag body having a bag-like shape and including an edge portion that is tightly fixed to the proximal-end edge portion and seals the proximal-end opening, and a reversing part which is surrounded by the edge portion, has flexibility, and is reversed inside/outside; and a space surrounded by the container body, the plug body and the bag body. The reversing part is reversed inside/outside when the liquid enters and exits the space through the mouth section, whereby the reversing part can take a first state in which the reversing part expands toward a distal end side, and a second state in which the reversing part expands toward the proximal end side.

17 Claims, 13 Drawing Sheets

(51) Int. Cl.
*A61J 1/20* (2006.01)
*A61J 1/16* (2006.01)
*A61J 3/00* (2006.01)

(52) U.S. Cl.
CPC ..... *A61J 1/201* (2015.05); *A61J 1/2072* (2015.05); *A61J 3/002* (2013.01); *A61J 2200/50* (2013.01)

(56) References Cited

U.S. PATENT DOCUMENTS

2011/0160693 A1 6/2011 Imai
2012/0053529 A1 3/2012 Imai

FOREIGN PATENT DOCUMENTS

WO WO 2010/122872 A1 10/2010
WO WO 2011/093389 A1 8/2011

* cited by examiner

MEDICAL CONTAINER AND METHOD OF MANUFACTURING THE SAME

CROSS REFERENCE TO RELATED APPLICATIONS

This application claims priority as a continuation application under 35 U.S.C. §120 to International Application No. PCT/JP2012/071308 filed on Aug. 23, 2012, designating the U.S., and which claims priority to Japanese Application No. 2011-195013 filed on Sep. 7, 2011, the entire content of both of which is incorporated herein by reference.

TECHNICAL FIELD

The present invention relates to a medical container and a method of manufacturing the medical container.

BACKGROUND DISCUSSION

Normally, many medicines are stored in vial containers (medicine-storing containers) each having a mouth section sealed with a rubber plug. The medicines include, for example, a liquid preparation or a powdery preparation that has to be dissolved. A method of operating a vial container in the former case (hereafter referred to as "Case 1") and a method of operating a vial container in the latter case (hereafter referred to as "Case 2") will be described below.

Case 1

(1) A cap that covers a mouth section of the vial container is detached.

(2) A rubber plug of the vial container is disinfected with cotton containing alcohol.

(3) Air slightly less than a liquid amount to be collected is injected into a syringe.

(4) A needle mounted on the syringe is stabbed orthogonally through the rubber plug.

(5) The vial container is turned upside down together with the syringe, and a position of the vital container is adjusted such that a needlepoint is located lower than a liquid surface. Then, an appropriate amount of the liquid medicine is sucked into the syringe. In this instance, a pressure inside the vial container becomes negative.

(6) The position of the vital container is adjusted such that the needlepoint is located higher than the liquid surface, and the air is returned into the vial container at the mercy of a pressure difference by the amount that has been sucked.

(7) The above steps (5) and (6) are repeated, and a prescribed amount of the medicine is collected.

(8) After completion of collecting the medicine, an appropriate amount of the air is sucked from the vial container, and the needle is taken out, keeping the pressure inside the vial container negative.

Case 2

(1) A syringe filled with dissolving liquid to dissolve a medicine is prepared.

(2) A cap that covers a mouth section of the vial container containing the medicine is detached.

(3) A rubber plug of the vial container is disinfected with cotton containing alcohol.

(4) The needle mounted on the syringe is stabbed orthogonally through the rubber plug.

(5) Air is released from the vial container by the amount of the dissolving liquid to be injected so as to make the pressure inside the vial container negative.

(6) The dissolving liquid is slowly injected at the mercy of a pressure difference without foaming.

(7) After injection of the dissolving liquid, the vial container is slowly shaken with the syringe fixed together therewith so as to dissolve the medicine. Incidentally, in the case where the medicine is hardly dissolved, the needle is to be taken out once, and then the container is shaken. In this instance, preferably the needle is taken out, keeping the pressure inside the vial container negative.

(8) After confirming that the medicine is completely dissolved, a necessary amount of the medicine is collected in the same method as Case 1.

(9) In the case where a full amount of the medicine specified in the Drug Standards is not to be used, a necessary amount of the liquid medicinal is measured by graduations of the syringe. However, in this case, the pressure inside the vial container may temporarily become positive. Therefore, when the needle is to be taken out, an appropriate amount of air is to be sucked before taking out the needle so as to keep the pressure inside the vial container negative, paying careful attention not to leak any medicinal liquid from a needle hole.

In both Cases 1 and 2, pressure control (steps (5) to (7) in Case 1, and steps (5) and (9) in Case 2) is required, which is laborious.

Also, in the case of a medicine that is dangerous if exposed to a user, such as carcinostatic agents, special attention has to be paid to controlling the pressure. In the case where this pressure control is not carried out correctly, there is a possibility, for example, that the medicine will be splattered from the vial container at the time of taking out the needle. The reason why the medicine may be spattered is that the pressure inside the vial container is positive. Additionally, there is a possibility that the medicine may leak from the needle hole. The reason for this leakage of the medicine is that, when the pressure inside the vial container is negative, force is applied from the syringe to the medicine inside the vial container.

To solve the above problems, there is a known technique of using a medicine-storing container including: a container body formed of a hard tube body; and a flexible bag body disposed inside the container body, in which powdery medicine is contained inside a medicine storing space surrounded by the container body and the bag body. For example, in the medicine-storing container disclosed in International Patent Publication No. WO2010/122872, a syringe filled with dissolving liquid that dissolves the medicine can be connected to a mouth section of the container body. The flexible bag body can be reversed inside and outside by the syringe discharging and suctioning in this connected state. As a result, a rise (increase) or a drop (decrease) of the pressure inside the medicine containing space can be suppressed. With this configuration, discharging and suctioning of the syringe can be easily performed, omitting the above-described pressure control.

The flexile bag body may take a first state in which the bag body expands toward a distal end side, and a second state in which the bag body expands toward a proximal end side when the bag body is reversed as described above. When a medicinal liquid is drawn into the syringe, the bag body takes the first state, in which the bag body contacts an inner peripheral portion of the container body.

However, in this instance, some of the medicinal liquid may not be drawn into the syringe and it will remain, being stuck at a small clearance between the bag body and the inner peripheral portion of the container body because of capillary phenomenon (surface tension). As a result, there is a problem in that a target amount of the medicinal liquid cannot be accurately drawn up and collected.

SUMMARY

The disclosure herein provides a medical container capable of easily and reliably collecting liquid filled inside a tube body, and a method of manufacturing the medical container.

A medical container according to an exemplary embodiment of the disclosure here includes a tube body having a tubular shape and including an inner peripheral portion inside the tube body, a mouth section through which liquid can enter and exit a distal end portion, a proximal-end opening at a proximal end section, and a proximal-end edge portion surrounding the proximal end opening, a plug body that seals the mouth section, a bag body having a bag-like shape and including an edge portion which is tightly fixed to the proximal-end edge portion and seals the proximal end opening, and a reversing part which is surrounded by the edge portion, has flexibility, and is reversed inside and outside, and a space surrounded by the tube body, the plug body, and the bag body.

The reversing part is reversed inside/outside when the liquid enters and exits the space through the mouth section, whereby the reversing part can take a first state in which the reversing part expands toward a distal end side, and a second state in which the reversing part expands toward the proximal end side, and in both the first state and the second state, the reversing part is separated from the inner peripheral portion of the tube body.

Further, in the medical container according to the disclosure here, preferably, in the first state, a separation distance between the reversing part and the inner peripheral portion of the tube body gradually increases in a direction away from the edge portion along an axial direction of the tube body.

Still further, in an exemplary embodiment of the medical container according to the disclosure here, a center portion of the reversing part on the other side of the edge portion has a flat shape in both the first state and the second state.

Additionally, in an exemplary embodiment of the medical container according to the disclosure here, preferably, the space is preliminarily filled with the medicine when the reversing part is in the first state, and the medicine partly contacts at least a proximal end portion of a space-side surface of the reversing part when the reversing part is in the first state.

Preferably, the medical container according to an exemplary embodiment of the disclosure further includes a protection cover which is mounted on a proximal end section of the tube body and covers the reversing part from its proximal end side.

Further, in the medical container according to the disclosure, the protection cover, preferably, includes a vent hole through which air enters and exits the protection cover.

In addition, in the medical container according to the disclosure, preferably, a syringe filled with liquid can be connected to the mouth section via a connector, and the tube body includes a rotation preventing means which prevents the connector from rotating about the axis of the tube body when the connector is connected to the mouth section.

A method of manufacturing an exemplary embodiment of the medical container according to the disclosure here, in which the medical container preliminarily contains a medicine in a space surrounded by the tube body and the bag body, includes: a first step of containing a liquid composition including the medicine in the space; and a second step of freeze-drying the liquid composition and generating the medicine. In the second step, a cooling jig contacting the reversing part in the first state is used to cool the liquid composition via the reversing part.

According to an exemplary embodiment of the method disclosed here, at the time of collecting the liquid filled inside the tube body, the reversing part is in the first state in which the reversing part is separated from the inner peripheral portion of the container body, whereby a gap is formed between the reversing part and the inner peripheral portion of the container body. This makes it possible to reliably flow down the liquid to the mouth section of the tube body through the gap. As a result, a prescribed amount of the liquid can be sufficiently, easily and reliably collected.

BRIEF DESCRIPTION OF DRAWINGS

These and other features and advantages of the disclosure will become more readily apparent to those skilled in the art upon reading the following detailed description, in conjunction with the appended drawings in which.

DETAILED DESCRIPTION

A medical container and a method of manufacturing the medical container according to exemplary embodiments of the disclosure will be described in detail below, based on preferred embodiments shown in the accompanying drawings.

First Embodiment

FIGS. 1 to 5 are views each showing in order a method of operating a medical container according to a first exemplary embodiment of the disclosure. For convenience of description, the lower side in FIGS. 1 to 4 and FIGS. 8 to 11 (also in FIGS. 12 to 16) will be referred to as "proximal end side" or "lower side (downward)" and the upper side therein as "distal end side" or "upper side (upward)", and the upper side in FIG. 5 will be referred to as "proximal end side" or "upper side (upward)" and the lower side therein as "distal end side" or "lower side (downward)".

As shown in FIGS. 2 to 5, a medical device set 10 includes a medical container 1, a syringe 20, and a connector (adapter) 30. The configuration of each of these components will be described below.

Figure 1:
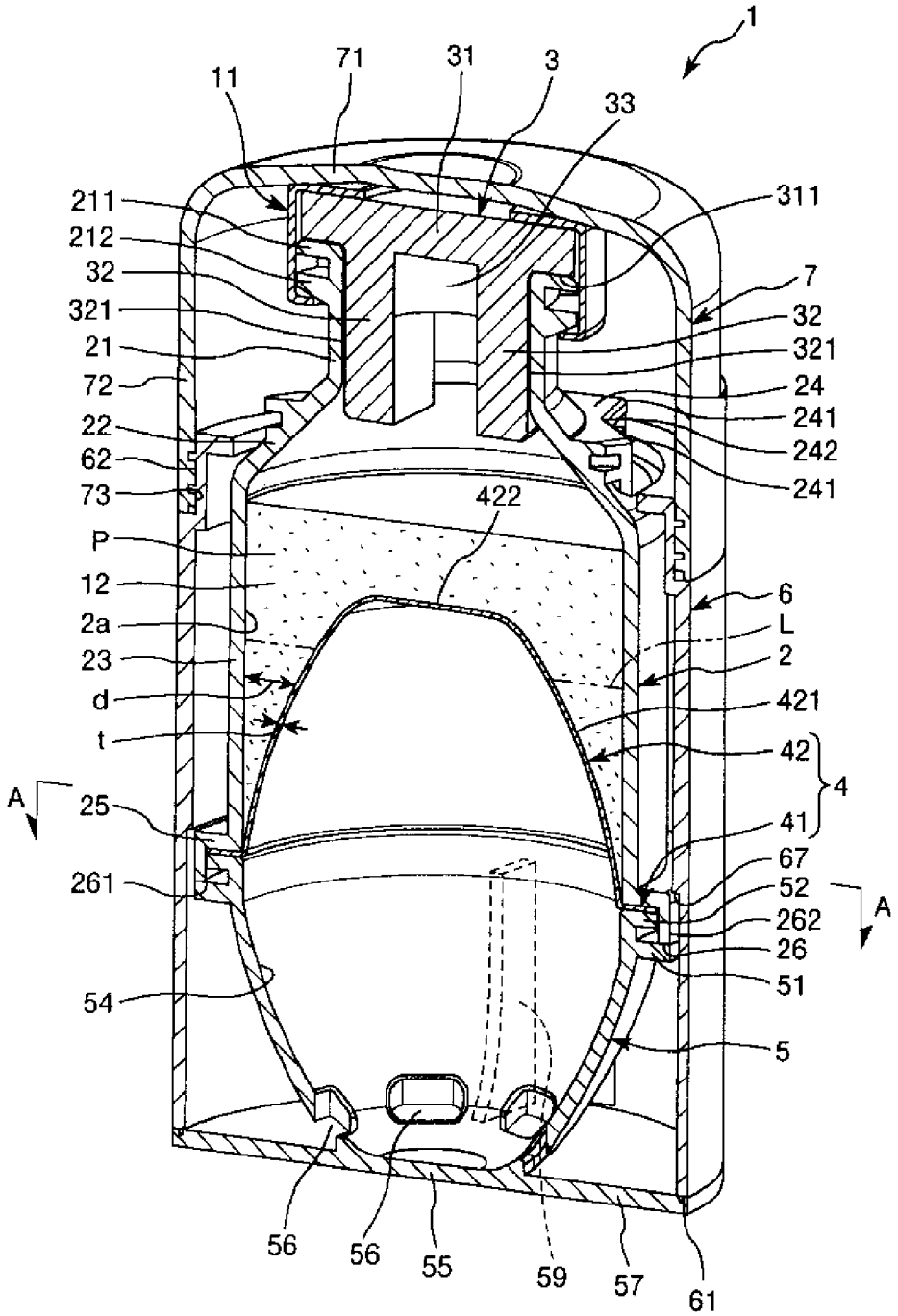
FIG. 1 is a longitudinal sectional perspective view showing a method of operating a medical container according to a first exemplary embodiment of the disclosure.

As shown in FIG. 1, the medical container 1 includes a container body 2, a plug body 3, a bag body (balloon) 4, a protection cover 5, an outer cover member 6, and a cap 7. Further, a powdery or liquid medicine P (powdery medicine in the illustrated embodiment) is preliminarily contained inside the medical container 1. This medicine P is mixed with a liquid Q, such as a dissolving liquid, a diluting liquid, and a medicinal solution, supplied from a syringe 20. This mixture is to be a medicinal liquid R.

Though not specifically restricted, examples of the medicine P include: medicines which are dangerous if erroneously touched by a medical worker, such as carcinostatic agents, immunosuppressants; medicines which have to be dissolved in use, such as antibiotics, styptics; medicines which need dilution, such as pediatric drugs; medicines which need multi-time dispensing, such as vaccines, heparin, pediatric drugs; medicines, such as protein preparations, which are easily foamed when dissolving or when drawn into the syringe; and medicines, such as anti-body drugs, in which a small quantity of medicine is contained. An example of the liquid Q may be physiological saline.

As shown in FIGS. 1, 3 to 5 and 8 to 11, the container body 2 is a member formed of a cylindrical body with each of both ends opened. The container body 2 can be divided, by the inside diameter size, into a mouth section 21, a shoulder section 22, and a barrel section 23 (section preferably having a constant inside diameter) sequentially from the distal end side.

Figure 3:
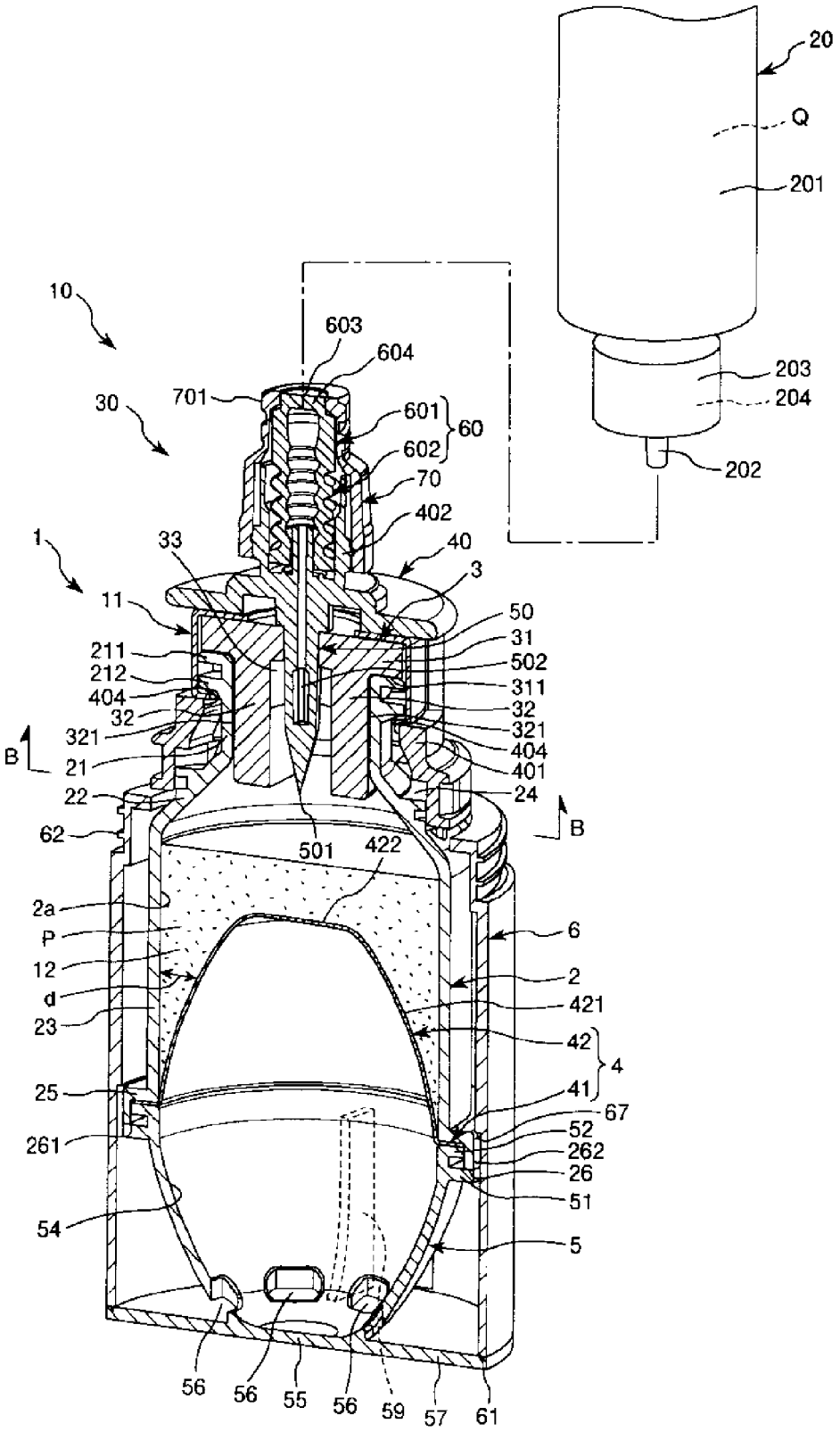
FIG. 3 is a longitudinal sectional perspective view showing the method of operating the medical according to a first exemplary embodiment of the disclosure.
Figure 4:
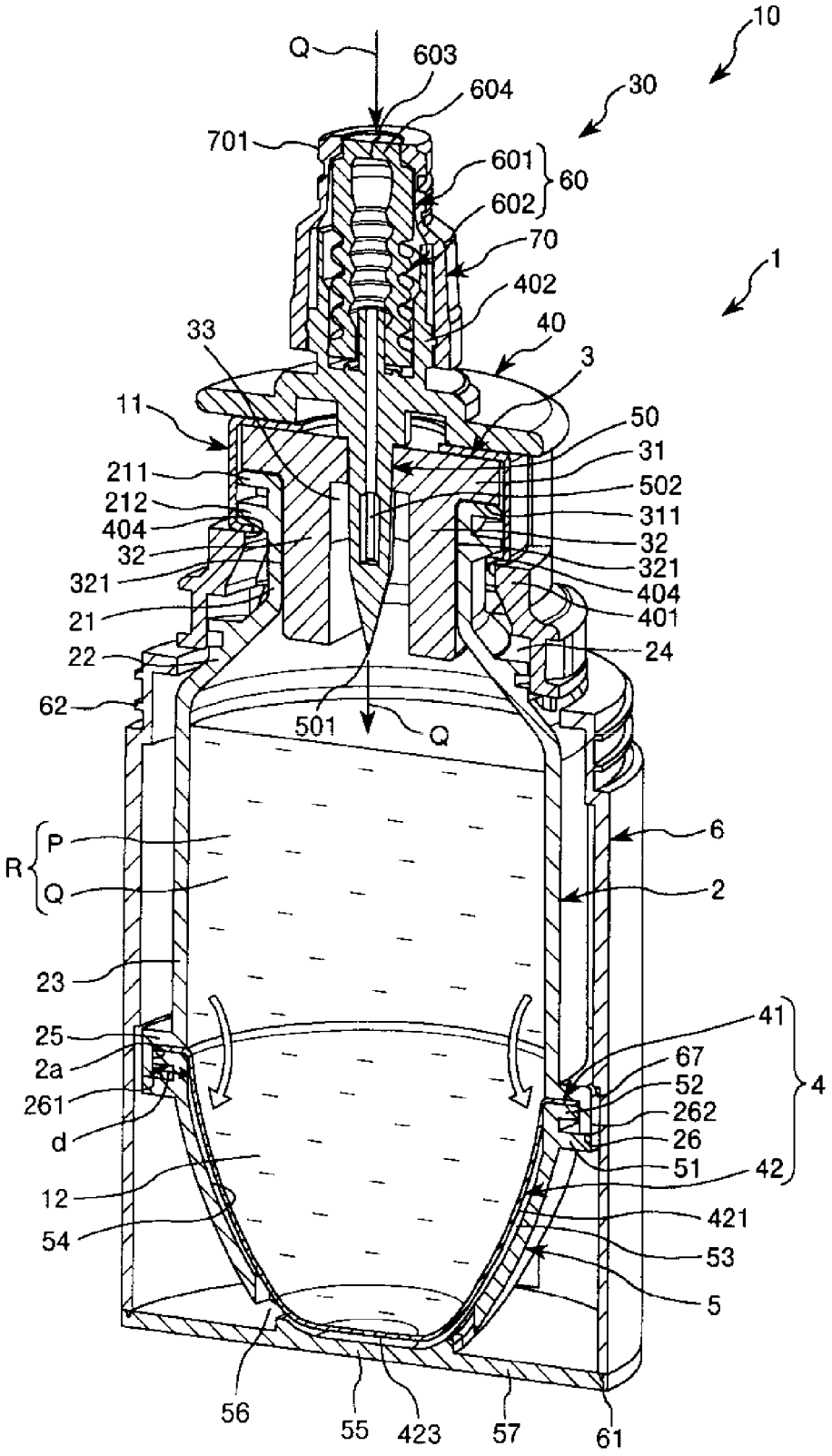
FIG. 4 is a longitudinal sectional perspective view showing the method of operating the medical container according to a first exemplary embodiment of the disclosure.
Figure 5:
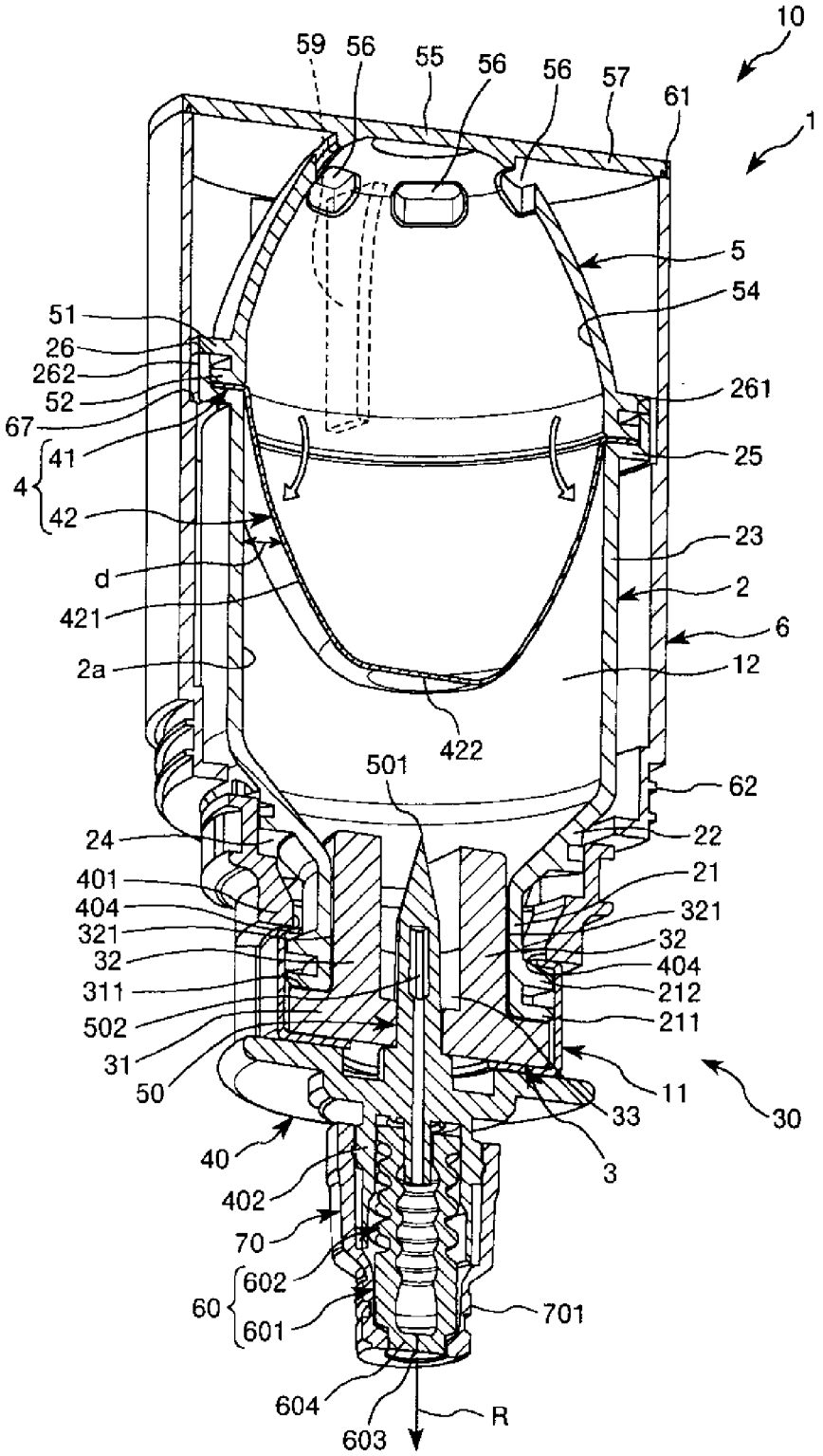
FIG. 5 is a longitudinal sectional perspective view showing the method of operating the medical container according to a first exemplary embodiment of the disclosure.

The inside diameter of the mouth section 21 is preferably constant along an axial direction, and is smaller than the inside diameter of the barrel section 23. As shown in FIGS. 3 to 5, the connector 30 can be mounted on the mouth section 21, and the syringe 20 is connected via the connector 30. Further, when the syringe 20 is operated while thus connected, the liquid Q flows from the syringe 20 into the container body 2 (see FIG. 4) or the medicinal liquid R flows out from the container body 2 to the syringe 20 (see FIG. 5) via the mouth section 21.

Further, two ring-shaped projected sections 211 and 212 are formed in a radially projecting manner on an outer peripheral portion of the mouth section 21 along the circumferential direction thereof. The projected sections 211 and 212 are spaced apart in the axial direction of the container body 2. Between the projected sections 211 and 212, a plurality of ribs (not shown) is provided at equal intervals in the circumferential direction of the container body 2. The spaced "apart" configuration of the projected sections 211 and 212 contributes to preventing the area of the mouth section 21 from deforming at the time of molding the container body 2.

Figure 2:
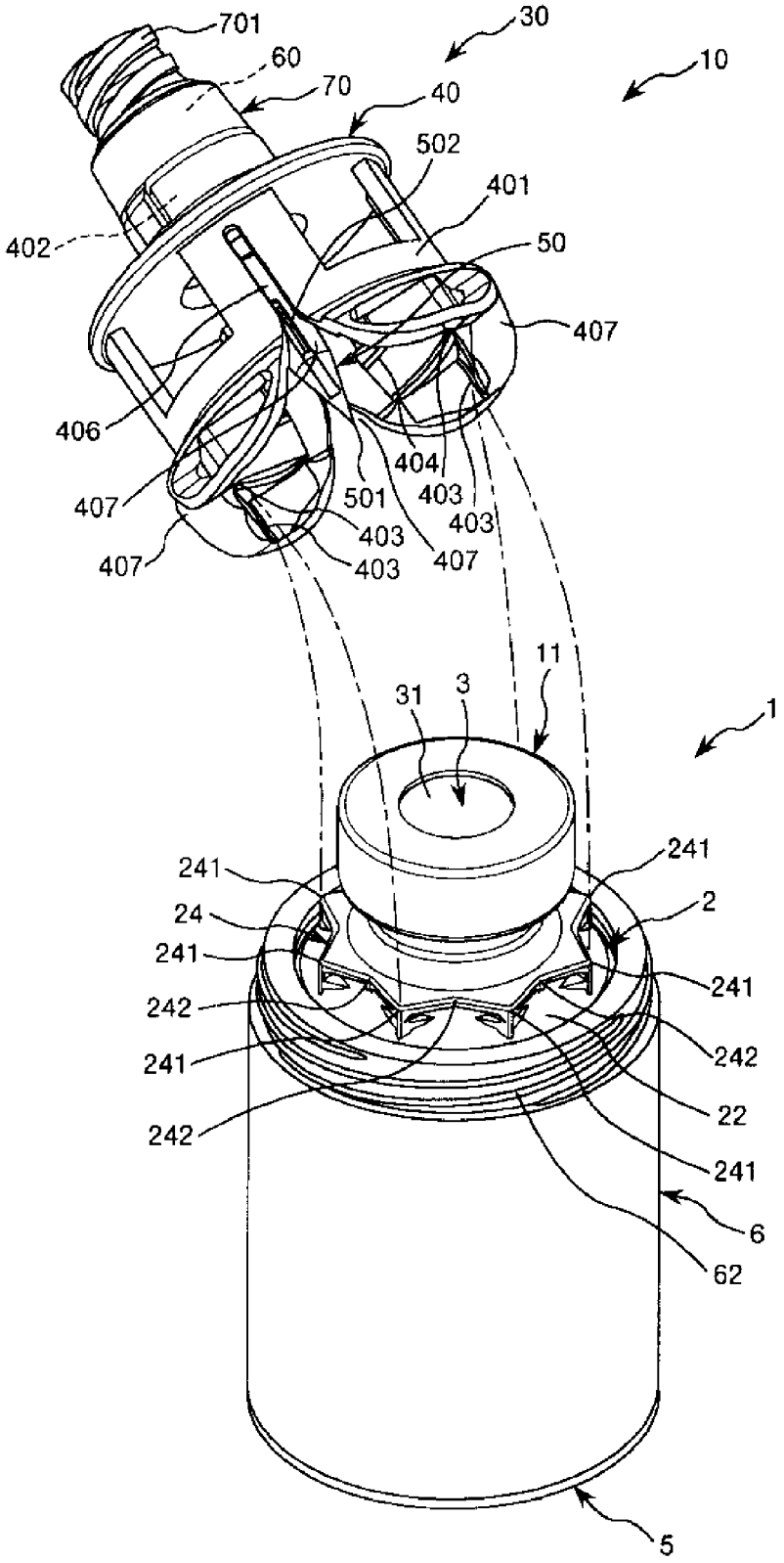
FIG. 2 is a perspective view showing the method of operating the medical container according to a first exemplary embodiment of the disclosure.

The shoulder section 22 is a portion where the inside diameter thereof gradually increases in the proximal end direction. As shown in FIG. 2, a rotation preventing projection 24 is protrudingly formed upward on an outer peripheral portion of this shoulder section 22. This rotation preventing projection 24 controls a position of the connector 30 around the axis of the connector 30, and functions as a rotation preventing means that prevents the connector 30 from rotating about the axis of the container body 2 when the connector 30 is connected to the mouth section 21. The rotation preventing projection 24 has a polygonal shape from the top view, and includes eight corner sections 241 projected outward and eight corner sections 242 recessed inward. The corner sections 241 and the corner sections 242 are arranged alternately around the axis of the container body 2.

The inside diameter of the barrel section 23 is substantially constant along the axial direction, and is larger than the inside diameter of the mouth section 21. A proximal-end opening 261 and a proximal-end edge portion 25 surrounding the proximal-end opening 261 are formed on the proximal end side of the barrel section 23. The proximal-end edge portion 25 is a ring-shaped flange formed along the circumferential direction of the barrel section 23. Further, a proximal-end outer peripheral portion 262 is formed on the outer periphery of the proximal-end edge portion 25, protrudes in the proximal end direction orthogonal to the proximal-end edge portion 25, and covers the entire outer periphery of the proximal-end edge portion.

The material constituting the container body 2, and other components, i.e., the protection cover 5, the outer cover member 6, and the cap 7 is not specifically restricted. Examples of suitable materials include resin materials, such as polyolefins like polyethylene, polypropylene, cyclic polyethylene; polyesters such as polyethylene terephthalate; vinyl resins such as polyvinyl chloride resin, polyvinyl alcohol; polyamide such as nylon 6, nylon 6.6, nylon 6.10, nylon 6.12; and other thermoplastic resins, and any one of these examples or a combination of two or more of these examples may be used. Also, a material added with a light shielding additive may be used to cut a specific wavelength. Further, the inner surface of the container body 2 may be coated with, for example, Teflon ("Teflon" is a registered trademark) or fluorine, to avoid absorption of the medicine P. Preferably, the respective components have transparency for securing visibility of the inside thereof.

A plug body 3 formed of an elastic material is mounted on the mouth section 21 of the container body 2. This ensures the mouth section 21 can be sealed in a liquid-tight manner.

As shown in FIGS. 1, 3 to 5, 10 and 11, the plug body 3 include a top plate 31 formed of a disk-shaped plate, a pair of leg portions 32 projecting from a proximal end surface 311 of the top plate 31, and a tubular section 33 provided between the top plate 31 and the pair of leg portions 32.

The pair of leg portions 32 is formed of plate pieces arranged apart and facing each other. Outer surfaces 321 of the leg portions 32 are each formed in an arc-shape along an inner peripheral portion of the mouth section 21 (see FIG. 7).

When the pair of leg portions 32 is inserted into the mouth section 21 of the container body 2, the plug body 3 is reliably prevented from being detached from the mouth section 21 in a temporarily-plugged state which will be described later.

Further, when the pair of leg portions 32 is more deeply inserted into the mouth section 21 of the container body 2, the tubular section 33 comes to contact the inner peripheral surface of the mouth section 21. Thus, the mouth section 21 is sealed in a liquid-tight manner.

The mouth section 21 of the container body 2 is covered with a body cap 11 together with the plug body 3, and the body cap 11 is formed of, for example, aluminum. The body cap 11 is engaged with the projected section 212 of the mouth section 21. With this structure, the plug body 3 is more reliably prevented from being detached from the mouth section 21.

Examples of the elastic material constituting the plug body 3 include various rubber materials, such as natural rubber, isoprene rubber, butadiene rubber, styrene-butadiene rubber, urethane rubber, fluorine-contained rubber, various thermoplastic elastomers based on styrene, polyolefin or the like, and any one of these examples or a combination of two or more of these examples may be used.

As shown in FIGS. 1, 3 to 5, and 8 to 11, the bag body 4 according to a first exemplary embodiment has a bag-like shape, that is, it has a cup-like shape (bowl-like shape) in a state of nature in which no external force is applied. Further, a space 12 for containing a medicine is defined by the bag body 4, container body 2, and the plug body 3 in the medical container 1. In this space 12, the medicine P is preliminarily contained.

The bag body 4 includes an edge portion 41 and a reversing part 42 surrounded by the edge portion 41.

As shown in FIG. 1, the edge portion 41 is tightly fixed to the proximal-end edge portion 25 formed at the proximal end of the container body 2. This edge portion 41 is supported by the proximal-end edge portion 25 such that the reversing part 42 folds an edge of the opening section of the bag-shaped bag body 4 outwardly. With this configuration, force is applied to the bag-shaped reversing part 42 in a direction (orthogonal to the axis of the container body 2) in which the reversing part 42 is reversed inside and outside (hereinafter referred to as "inside/outside") of the bag (the reversing part 42), that is, a front-side and back-side of the bag. As a result, the reversing part 42 can be stably and easily reversed.

In the case where the protection cover 5, which will be later described, and a cooling jig 80 are not mounted on the container body 2, the edge portion 41 which is to be a welding part between the bag body 4 and the container body 2 can be protected by the proximal-end outer peripheral portion 262 of the container body 2. For example, even when the container body 2 mounted with no protection cover or no cooling jig is directly placed on a table (stand), the container body 2 contacts the table via the proximal-end outer peripheral portion 262. Thus, the welding part (edge portion 41) of the bag body 4 can be protected. Even when the container body 2 placed on the table is moved to a different position on the table, the welding part of the bag body 4 can be protected and prevented from being damaged in the same manner.

The above-described bag body 4 can be obtained by heating and deforming a flexible sheet material by using, for example, a mold. Examples of the molding method include vacuum molding and pressure molding, and more particularly, vacuum molding by plug assist process is preferred. Further, the thickness t of the sheet material (bag body 4) is not specifically restricted. For example, the thickness of the reversing part 42 is preferably from 0.03 to 0.5 mm, and more preferably from 0.05 to 0.3 mm. Preferably, the thickness of the edge portion 41 of the bag body 4 is, for example, from 0.05 to 0.7 mm, and more preferably from 0.07 to 0.4 mm. The material constituting the sheet material is not specifically restricted, but examples include: polyolefin resin such as polyethylene, polypropylene, cyclic polyethylene; blend resin or copolymerized resin including the polyolefin resin; polyester resin such as polyethylene terephthalate; polyamide resin such as nylon; single-layer film such as, polyvinylidene chloride, vinyl chloride-polyvinylidene chloride copolymer; single-layer film obtained by vapor-depositing aluminum, silica, etc. onto the mentioned single-layer film; multilayer film obtained by laminating the mentioned single-layer films, other film, and metal foil such as aluminum. Particularly, a material having water-vapor barrier properties or oxygen barrier properties is preferable. By using the above-mentioned sheet material, the bag body 4 which is configured to be reversed (reversed inside/outside) can be reliably molded.

A method of fixing the proximal-end edge portion 25 of the container body 2 to the edge portion 41 is not specifically restricted. Examples of a suitable method include: welding (such as thermal welding, RF welding, ultrasonic welding, and laser welding), and bonding (bonding with an adhesive or solvent). Among these methods, the welding method is more preferable.

As shown sequentially in FIGS. 3 to 5, the reversing part 42 is a portion which is reversed by the liquid Q flowing into the space 12 via the mouth section 21 of the container body 2 and by the medicinal liquid R flowing out from the space 12. With the reverse of the reversing part, a rapid inner pressure change inside the space 12 can be suppressed when the syringe 20 performs discharging and sucking. As a result, discharging and suctioning can be smoothly performed.

Additionally, the reversing part 42 may take two states: a first state in which the reversing part 42 is expanded toward the distal end side (see FIGS. 1, 3, and 5); and a second state in which the reversing part 42 is expanded toward the proximal end side (FIG. 4). In the unused state shown in FIG. 1, in which the medicine P is preliminarily contained in the space 12, the reversing part 42 is in the first state.

Further, the reversing part 42 is positioned inside the barrel section 23 of the container body 2 in the first state, and is protruded from the proximal-end opening 261 of the container body 2 in the second state.

In both the first state and the second state, a space-side surface 421 of the reversing part 42, which is the surface facing the space 12 side, is separated from an inner peripheral portion 2*a* of the container body 2. In this instance, a separation distance d gradually increases along the axial direction of the container body 2 in a direction away from the edge portion 41. In other words, the distance d gradually increases in a distal end direction in the first state, and in a proximal end direction in the second state.

It is preferable that 90% of the entire surface area of the space-side surface 421 of the reversing part 42 be separated from the inner peripheral portion 2*a* of the container body 2, and it is more preferable that 95 to 100% of the entire surface area of the space-side surface 421 of the reversing part 42 be separated from the inner peripheral portion 2*a* of the container body 2.

With the above-described configuration of the reversing part 42, when the medicinal liquid R inside the space 12 is drawn up and collected in the syringe 20, the reversing part 42 takes the first state (see FIG. 5), and the space between the space-side surface 421 of the reversing part 42 and the inner peripheral portion 2*a* of the container body 2 is enlarged toward the mouth section 21 of the container body 2. With this configuration, the medicinal liquid R can reliably and easily flow down to the mouth section 21 through the above-described space. As a result, a prescribed amount of the medicinal liquid R can be sufficiently, reliably and easily collected.

If the space-side surface 421 of the reversing part 42 contacts (in close contact with) the inner peripheral portion 2*a* of the container body 2 at the time of collecting the medicinal liquid R, the medicinal liquid R enters between the space-side surface 421 of the reversing part 42 and the inner peripheral portion 2*a* of the container body 2 due to the capillary phenomenon, and may not be suctioned out and will thus remain therebetween. In such a case, the prescribed amount of the medicinal liquid R cannot be collected. In other words, the amount of the collected medicinal liquid R is short by the remaining amount.

Accordingly, separation of the reversing part 42 from the container body 2 as in the exemplary embodiment of the disclosure improves a collection rate of the medicinal liquid R.

For example, assume that 10 cc of the liquid Q is filled in the space 12 from the syringe 20. This filling amount is a target amount of the medicinal liquid to be collected by the collecting operation. When the liquid Q is filled, the reversing part 42 is reversed from the first state to the second state and expands by the filling amount of the liquid Q (10 cc). Then, after the liquid Q is mixed with the medicine P by shaking, collecting is executed. The reversing part 42 is reversed from the second state to the first state by collecting, and can be returned to the original state by the filling amount, namely, the amount to be collected (target amount) of medicinal liquid. In this instance, the reversing part 42 is separated from the container body 2. Thus, the target amount of the medicinal liquid R can be easily and stably collected.

Additionally, in the unused state shown in FIG. 1, the medicine P contacts the entire part of the space-side surface 421 in the first state, and a clearance is generated between the reversing part 42 and the medicine P when the reversing part 42 is reversed from the first state. With this configuration, the liquid Q enters the clearance between the reversing part 42 and the medicine P when the liquid Q is filled into the space 12 from the syringe 20. Therefore, the widest contact area can be secured between the liquid Q and the medicine P. As a result, mixing of the liquid Q with the medicine P is sufficiently and reliably performed and an effect of shortening a time required for dissolving the medicine P with the liquid Q can be obtained.

Even in the case where the medicine P is filled merely up to the level indicated by the two-dot dashed line (virtual line L) in FIG. 1 (in the case where the medicine P does not contact the entire surface of the reversing part 42, namely, the entire part of the space-side surface 421), clearance is generated between the reversing part 42 and the medicine P when the reversing part 42 is reversed. Therefore, the contact area of the liquid Q and the medicine P is enlarged. In other words, the same effect can be obtained as long as the medicine P at least partly contacts a proximal end side of the space-side surface 421 in the first state.

In both the first state and the second state, a center portion of the reversing part 42 located on the other side of the edge portion 41 has a flat shape. More specifically, the center portion corresponds to a top portion 422 in the first state and a bottom portion 423 in the second state. Because of this flat shape, a volume of the space 12 in the unused state (first state) can be increased without enlarging the container body 2. Additionally, by forming this flat top portion 422 thicker and more constant than a surrounding area thereof, the reversing part 42 can be homogeneously reversed when the reversing part 42 is reversed from the first state to the second state because reversing starts from the surrounding area of the top portion 422.

As shown in FIGS. 1 and 3 to 5, the protection cover 5 is mounted on the proximal end section of the container body 2. The protection cover 5 is cup-shaped and covers the reversing part 42 of the bag body 4 from the proximal end side thereof. With this configuration, expansion of the reversing part 42 can be restricted even though the reversing part 42 tries to expand further when the reversing part 42 is changed to the second state. As a result, a burst or rupture in the event of excessive expansion of the reversing part 42 can be reliably prevented (see FIG. 4). Thus, the protection cover 5 protects the reversing part 42.

As shown in FIG. 4, when the reversing part 42 is changed to the second state, the reversing part 42 is normally separated from an inner surface 54 of the protection cover 5. In other words, a gap 53 is formed therebetween. With this configuration, the reversing part 42 can be prevented from contacting the inner peripheral portion of the protection cover 5 as much as possible. The size of gap 53 is not particularly limited, but preferably it is from 0.5 to 2.0 mm, and more preferably from 0.5 to 1.5 mm.

A first flange 51 and a second flange 52, both of which are ring-shaped, are formed in a projecting manner on a distal-end outer peripheral portion of the protection cover 5 along the circumferential direction. The first flange 51 is located closer to the proximal end side than the second flange 52. Also, the outside diameter of the first flange 51 is larger than that of the second flange 52.

The first flange 51 contacts a proximal end surface 26 of the proximal-end outer peripheral portion 262 of the container body 2. The first flange 51 may be fixed to the proximal end surface 26 by bonding or welding.

On the other hand, the second flange 52 functions as a holding section to hold the edge portion 41 of the bag body 4 between the second flange and the proximal-end edge portion 25 of the container body 2. By thus holding the edge portion, fixing of the edge portion 41 to the proximal-end edge portion 25 of the container body 2 can be reinforced.

Figure 6:
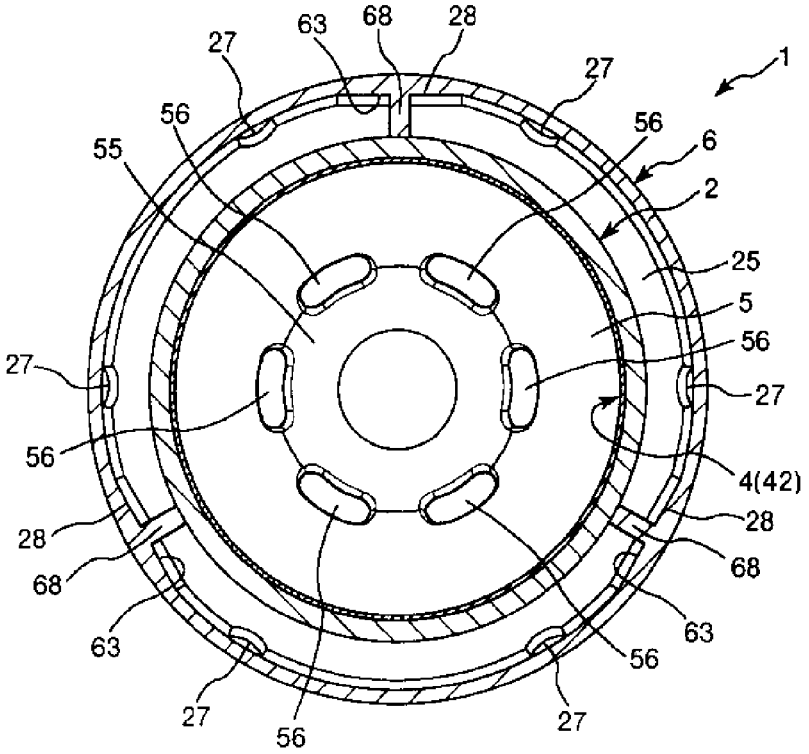
FIG. 6 is a cross-sectional view taken along a line A-A in FIG. 1.

A plurality of vent holes 56 penetrating a wall section of the protection cover 5 is formed near a bottom portion 55 of the protection cover 5 (six vent holes are formed in the exemplary configuration shown in FIG. 6). These vent holes 56 are arranged at intervals of equal angle in the circumferential direction around an axis of the protection cover 5. The air can enter and exit the protection cover 5 through these vent holes 56. With this configuration, the air between the bag body 4 and the protection cover 5 is pushed out when the reversing part 42 of the bag body 4 is changed from the first state to the second state, and vice versa, the air between the bag body 4 and the protection cover 5 is suctioned in when the reversing part 42 is changed from the second state to the first state. As a result, the reversing part 42 can be easily and reliably reversed.

The air pushed out is released to the atmosphere through a plurality of grooves 27 (see FIG. 6) formed on the outer peripheral surface of the proximal-end outer peripheral portion 262 of the container body 2. According to the configuration shown in FIG. 6, six grooves 27 are formed, and the grooves 27 are arranged at intervals of equal angle around the axis of the container body 2.

Further, a third flange 57 having a ring-like shape is formed in a projecting manner along the circumferential direction on the outer peripheral side of the bottom portion 55 of the protection cover 5.

As shown in FIG. 1, a plurality of blade parts 59 (e.g. three blade parts in the first exemplary embodiment) is formed between the second flange 52 and the third flange 57. These blade parts 59 are arranged at equal intervals along the circumferential direction of the protection cover 5.

The outer cover member 6 is formed of a tube body having both of the ends opened. The outer cover member 6 is capable of housing, inside thereof, most parts of the container body 2 and the protection cover 5. With this configuration, the container body 2 is covered with the outer cover member 6. Accordingly, in the case where the medicine P includes any medicine which is dangerous if erroneously touched by a medical worker, it is possible to prevent contamination of the circumference and secure safety for the medical worker even though the medicine P is adhered to the outer surface of the container body 2 while, for example, manufacturing the medical container 1. Additionally, the medical container 1 can be held by the outer cover member 6 same as the prior vial container.

A proximal end surface 61 of the outer cover member 6 is joined to the third flange 57 of the protection cover 5. This joining method is not specifically restricted. Examples thereof include welding and bonding. The third flange 57 can also be joined to a proximal end of the outer cover member 6 by engagement with the proximal-end inner peripheral surface of the outer cover member 6.

A stepped section 67, in which the inside diameter is rapidly changed, is formed on the inner peripheral portion of the outer cover member 6 at approximately halfway of the axial direction (see FIG. 1). The proximal-end edge portion 25 of the container body 2 is engaged with the stepped section 67, thereby determining the position of the stepped section 67 in the axial direction inside the outer cover member 6 of the container body 2.

Also, as shown in FIG. 6, a plurality of flat sections 63 is formed on the inner peripheral portion of the outer cover member 6 (according to the exemplary configuration shown in FIG. 6, three flat sections are formed at equal intervals in a circumferential direction of the outer cover member 6). The respective flat sections 63 can individually abut on a plurality of flat sections 28 and the outer peripheral surfaces of the blade parts 59 of the protection cover 5. The flat sections 28 are formed on the outer peripheral surface of the proximal-end outer peripheral portion 262 of the container body 2 (according to the exemplary configuration shown in FIG. 6, three flat sections are formed at equal intervals in the circumferential direction of the container body 2). With this configuration, the container body 2 and the protection cover 5 are reliably prevented from rotating about the axis thereof with respect to the outer cover member 6. By thus restricting the rotation, the outer cover member 6 is held, and connecting work can be easily carried out at the time of connecting the syringe 20 to the connector 30 mounted on the container body 2 by screw-engagement.

As shown in FIG. 6, a plurality of ribs 68 is formed in a projecting manner (three ribs are formed in the exemplary configuration shown in FIG. 6) on the inner peripheral surface of the outer cover member 6 which is closer to the distal end side than the stepped section 67. These ribs 68 are arranged at equal intervals along the circumferential direction of the outer cover member 6. Also, each of the ribs 68 supports the outer peripheral surface of the container body 2 from the outside thereof. With this configuration, the container body 2 can be prevented from being loose in a radial direction thereof inside the outer cover member 6.

A male screw 62 is formed on a distal-end outer peripheral portion of the outer cover member 6. This male screw 62 can be screw-engaged with the cap 7.

As shown in FIG. 1, the cap 7 includes a top plate 71 and a wall section 72 projected from an edge of the top plate 71 in the proximal end direction.

A female screw 73 is formed on the inner peripheral portion of the wall section 72. The cap 7 is detachably mounted on the outer cover member 6 by screw-engaging this female screw 73 with the male screw 62 of the outer cover member 6.

As shown in FIG. 3, the syringe 20 is preliminarily filled with the liquid Q to be mixed with the medicine P. This syringe 20 includes an outer tube 201. The outer tube 201 has a bottom tube-like shape, and the mouth section 202 projecting in the distal end direction is formed on a bottom portion thereof.

The syringe 20 also includes a gasket (not shown) slidable in a liquid-tight manner inside the outer tube 201, and a plunger (not shown) connected to the gasket and used to move the gasket inside the outer tube 201. The liquid Q can be discharged from the mouth section 202 using the gasket by pushing the plunger.

Additionally, a ring-shaped lock member (lock adapter) 203 is disposed concentrically with the mouth section 202 on an outer peripheral side of the mouth section 202. A female screw 204, which is to be screw-engaged with the connector 30, is formed on an inner peripheral portion of the lock member 203. The syringe 20 is connected to the connector 30 by this screw-engagement. The lock member 203 may be integrally formed with the mouth section 202, or may be formed separately from the mouth section 202. In the case where the lock member 203 is formed separately from the mouth section 202, the lock member 203 may be movably supported along the axial direction of the mouth section 202, or may be rotatably supported about the axis of the mouth section 202.

The above-described syringe 20 is connected to the medical container 1 via the connector 30.

As shown in FIGS. 2 to 5, and 7, the connector 30 includes a main body 40, a bottle needle 50, a valve body 60, and a cap 70.

The main body 40 includes a mounting section 401 to be mounted on the mouth section 21 of the container body 2, and a valve body installation section 402 where the valve body 60 is installed.

The mounting section 401 has a tubular shape, and can be fitted with the mouth section 21 of the container body 2 from the outside thereof.

Figure 7:
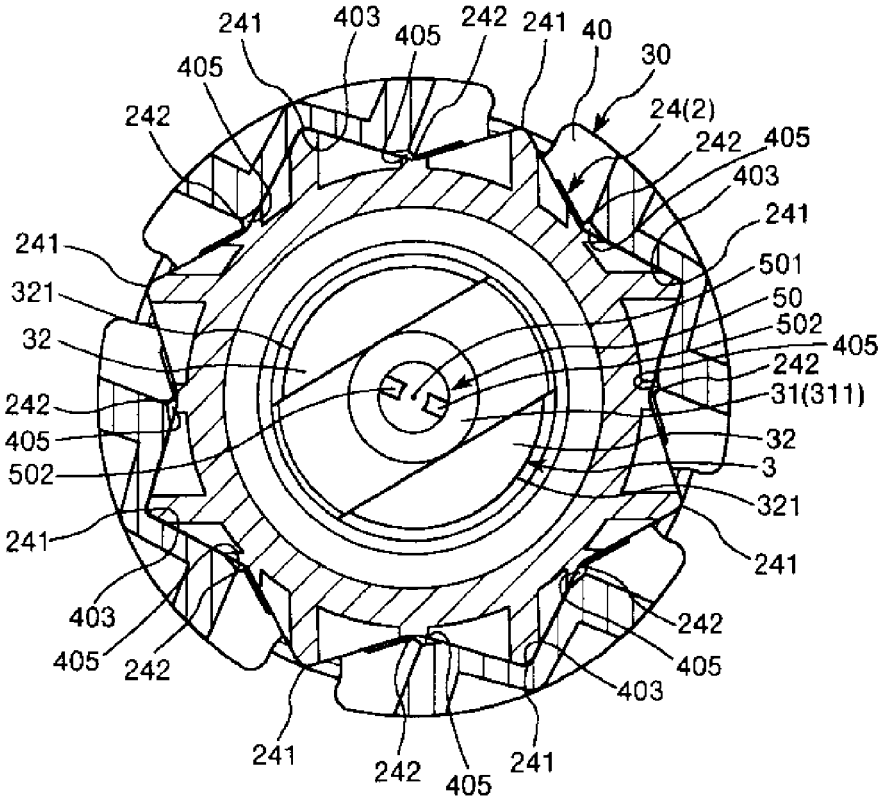
FIG. 7 is a cross-sectional view taken along a line B-B in FIG. 3.

Additionally, a plurality of corner sections 403 is formed on the inner peripheral portion of the mounting section 401 and recessed outward (four corner sections are formed in the exemplary configuration shown in FIGS. 2 and 7). These corner sections 403 are arranged at intervals of equal angle around the axis of the mounting section 401. Additionally, corner sections 405 are formed in an inwardly projecting manner on both sides of each corner section 403 (see FIG. 7).

As shown in FIG. 7, when the mounting section 401 is mounted on the mouth section 21 of the container body 2, the four corner sections 403 are respectively fitted (inserted) into four corner sections 241 out of the eight corner sections 241 of the rotation preventing projection 24 of the container body 2. With this configuration, the connector 30 is reliably prevented from rotating about the axis of the container body 2, and the syringe 20 can be easily connected to the connector 30 by screw-engagement. Even though the corner sections 405 of the mounting section 401 may abut on (hit) the corner sections 241 of the container body 2 when the mounting section 401 is mounted on the mouth section 21 of the container body 2, the corner sections 405 are guided by the corner sections 241, and the mounting section 401 rotates about the axis thereof because of this abutting. By this rotation, the respective four corner sections 403 are reliably fitted into the four corner sections 241 out of the eight corner sections 241 of the rotation preventing projection 24 of the container body 2, as described above. Thus, the connector 30 can be prevented from rotating about the axis of the container body 2.

Additionally, as shown in FIGS. 3 to 5, pawls 404 are formed in a projecting manner on the inner peripheral portion of the mounting section 401 in close proximity of the distal end side of the respective corner sections 403. When the mounting section 401 is fitted to the mouth section 21 of the container body 2, each pawl 404 is engaged with the projected section 212 of the mouth section 21. Hence, the connector 30 can be reliably prevented from unexpectedly being disengaged from the container body 2.

As shown in FIG. 2, the mounting section 401 includes slits 406 extending along the axial direction thereof, and each slit is formed between the adjacent corner sections 403. These slits allow the mounting section 401 to expand in a radial direction when the pawls 404 climb over the projected sections 211 and 212 of the mouth section 21 in the process of fitting the mounting section 401 to the mouth section 21. In this manner, the mounting section 401 can be easily mounted.

Further, an enlarged width section 407 that has a width becoming enlarged toward the proximal end side is formed on the proximal end section of each slit 406. Each of the corner sections 241 of the rotation preventing projection 24, which is not engaged with the corner sections 403 of the mounting section 401, can enter each of the enlarged width sections 407.

The valve body installation section 402 has a tubular shape smaller than mounting section 401, and the valve body 60 can be inserted into the valve body installation section.

The bottle needle 50 is disposed concentrically with the mounting section 401. The bottle needle 50 includes a sharp needlepoint 501 that can thrust through the top plate 31 of the plug body 3 of the medical container 1. Also, the bottle needle 50 is a hollow needle and includes at least one side hole 502 (two side holes in the exemplary embodiment) opened on the side surface thereof.

The valve body 60 is formed of a tubular elastic body, and can be divided into a head section 601 on the distal end side and a barrel section 602 on the proximal end side. The head section 601 includes a top plate 604 on which a slit 603 having self-closing properties is formed. When the syringe 20 is connected to the connector 30, the mouth section 202 of the syringe 20 presses the top plate 604 and deforms the top plate, thereby opening the slit 603. In the case where the syringe 20 starts discharging or suctioning in this state, the liquid can flow between the syringe 20 and the medical container 1 via the valve body 60 and the bottle needle 50.

Further, when the syringe 20 is detached from the head section 601, the syringe pressing force against the top plate 604 is released, thereby closing the slit 603.

The barrel section 602 has a bellows shape, and functions as a biasing section for biasing the head section 601 in the distal end direction. As a result, while the syringe 20 is detached, the head section 601 can stay in a designated position with respect to the cap 70.

The cap 70 is a tubular member covering the valve body 60. The proximal-end inner peripheral portion of this cap 70 is joined to the outer peripheral portion of the valve body installation section 402 of the main body 40. Also, the distal-end outer peripheral portion of the cap 70 can compress the top plate 604 of the head section 601 of the valve body 60 located at the designated position. This reliably closes the slit 603.

Further, a male screw 701 is formed on the outer peripheral portion of the cap 70. The female screw 204 of the lock member 203 of the syringe 20 can be screw-engaged with the male screw 701.

A method of operating the medical device set 10 (medical container 1) will be described below with reference to FIGS. 1 to 5.

First, as shown in FIG. 1, the medical container 1 which is in the unused state and preliminarily contains the medicine P in the space 12 is prepared. Then, the cap 7 is detached from this medical container 1. Here, the cap is detached by releasing the screw-engagement between the cap 7 and the outer cover member 6.

Next, as shown in FIG. 2, the medical container 1, from which the cap 7 has been detached, is placed on the table (not shown), for example, such that the mouth section 21 of the container body 2 faces upward. Subsequently, the connector 30 is brought near and mounted on the mouth section 21 of the container body 2 from the top thereof. In this instance, the four corner sections 241 of the rotation preventing projection 24 of the container body 2 are fitted with the four corner sections 403 of the main body 401 of the connector 30, whereby rotation of the connector 30 is restricted with respect to the container body 2.

Next, as shown in FIG. 3, the syringe 20 is connected to the connector 30 mounted on the medical container 1 (mouth section 21 of the container body 2) (hereafter, this state is referred to as the "connected state"). The above connecting work is carried out by screw-engaging the female screw 204 of the lock member 203 of the syringe 20 with the male screw 701 of the cap 70 of the connector 30. Further, at the time of this connecting work, rotation of the connector 30 is restricted with respect to the container body 2 as described above. Therefore, the connecting work can be reliably carried out. Further, since rotation of the outer cover member 6 with respect to the container body 2 is restricted as well in the medical container 1, the above connecting work can be carried out, holding the outer cover member 6.

In the connected state, the slit 603 of a valve body 60 of the connector 30 is put into an opened state as described above.

Thereafter, the plunger of the syringe 20 is pushed during the connected state, and the liquid Q is supplied from the syringe 20 into the space 12 of the medical container 1 as shown in FIG. 4. This liquid Q flows down through the valve body 60 and the bottle needle 50, and flows into the space 12 through the side hole 502 of the bottle needle 50. Thus, the liquid Q is mixed with the medicine P, and the medicinal liquid R starts to be generated.

The reversing part 42 of the bag body 4 is changed as well to the second state by being pressed by the liquid Q which has flown into the space 12. As a result, the volume of the space 12 is increased, whereby an excessive increase of the inner pressure of the space 12 caused by pushing the plunger can be suppressed. Thus, pressure control steps can be omitted in the exemplary embodiment of the disclosure here, while it has heretofore been necessary to control the pressure inside the prior art vial container containing the powdery medicine by drawing the air into the syringe from the vial container by an amount corresponding to the dissolving liquid to be injected.

Thereafter, the medicine P is completely dissolved in the liquid Q by shaking, and the medicinal liquid R is generated. In this instance, the liquid Q enters between the reversing part 42 and the medicine P as described above, and a contact area between the liquid Q and the medicine P is enlarged, whereby the liquid Q and the medicine P can be sufficiently and reliably mixed. As a result, the shaking time can be shortened.

Next, the medical container 1 is turned upside down as shown in FIG. 5, maintaining the connected state. Then, the plunger of the syringe 20 is pulled to collect the medicinal liquid R into the syringe 20. In this instance, the reversing part 42 of the bag body 4 is pulled together with the medicinal liquid R, and changed to the first state. At this point, the space-side surface 421 is separated from the inner peripheral portion 2*a* as described above. Therefore, the medicinal liquid R can easily and reliably flow down to the mouth section 21 of the container body 2, passing between the space-side surface 421 of the reversing part 42 and the inner peripheral portion 2*a* of the container body 2. As a result, the medicinal liquid R can be easily and reliably collected. Also, since the reversing part 42 returns to the first state, it is possible to prevent the pressure inside the container body 2 (space 12) from being negative during the suctioning operation. Thus, pressure control steps can be omitted in the exemplary embodiment of the disclosure here, while it has heretofore been necessary to control the pressure inside the prior art vial container containing the powdery medicine by returning the air from the syringe to the vial container by the amount of the medicinal liquid drawn into the syringe.

Incidentally, in the case where the medicinal liquid R is preliminarily filled inside the container body 2, the reversing part 42 in the unused state is in the second state. Accordingly, when the medicinal liquid R is collected to the syringe 20, the reversing part 42 is changed to the first state. Therefore, it is possible to prevent the pressure inside the container body 2 (space 12) from being negative at the time of suctioning. Hence, it is possible to omit the pressure control step in which the air is returned to the prior art vial container from the syringe by the amount of the medicinal liquid drawn into the syringe.

A method of manufacturing the medical container 1 (method of manufacturing a medical container) will be described next with reference to FIGS. 8 to 11. This manufacturing method includes [1] preparing step, [2] containing step (first step), [3] plugging step, [4] generating step (second step), and [5] assembling step. Preferably, the respective steps described below are carried out in an aseptic environment, such as inside an isolator.

From the preparing step [1] to the generating step [4], a cooling jig 80 is used. First, this cooling jig 80 will be described.

The cooling jig 80 is detachably mounted on the bag body 4 in the first state. The cooling jig 80 includes a cup-shaped section 801 and a ring-shaped flange 802. The cup-shaped section 801 has a cup-like shape which corresponds to, namely, the shape of the reversing part 42 of the bag body 4 in the first state. The ring-shaped flange 802 is formed on a proximal-end outer peripheral portion of the cup-shaped section 801 in a projecting manner along the circumferential direction thereof.

When the cooling jig 80 is mounted on the bag body 4, the cup-shaped section 801 contacts the reversing part 42 of the bag body 4 from the proximal end side thereof, and the flange 802 is used as a stage to mount a first structure 101. Further, the cooling jig 80 in this state is capable of cooling a liquid composition S, which will be described later, via the reversing part 42.

The cooling jig 80 is formed of a metallic member. A material of the metallic member is not specifically restricted. Possible examples include stainless steel, aluminum, and aluminum alloy. By using such metallic materials, the cooling jig 80 may have excellent heat conductivity and is able to reliably cool a liquid composition S.

As described above, the method of manufacturing the medical container 1 includes [1] preparing step, [2] containing step (first step), [3] plugging step, [4] generating step (second step), and [5] assembling step.

[1] Preparing Step

Figure 8:
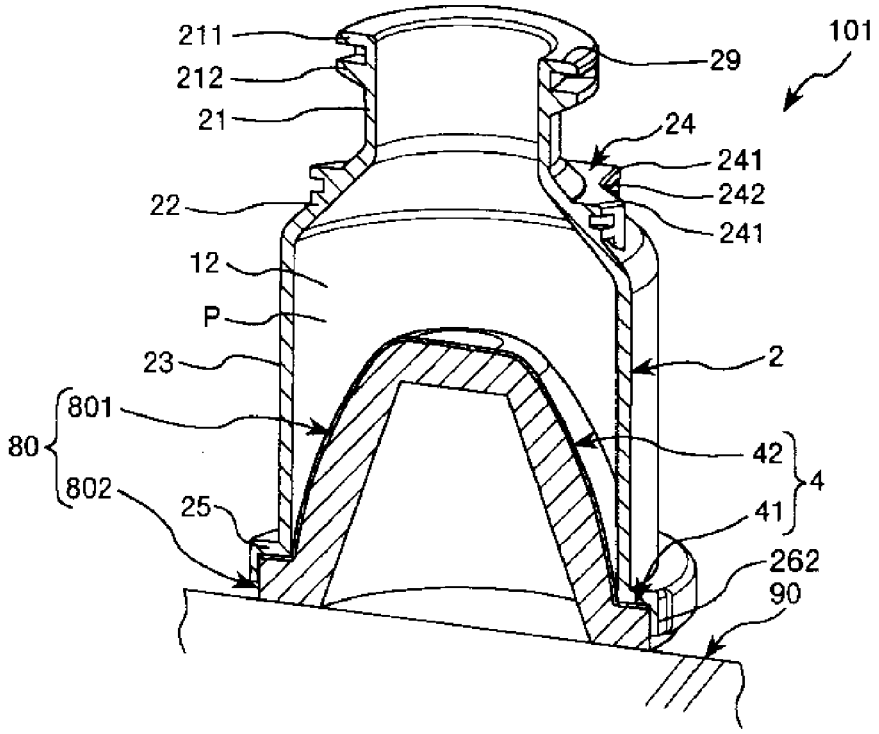
FIG. 8 is a longitudinal sectional perspective view showing a method of manufacturing the medical container according to a first exemplary embodiment of the disclosure.

As shown in FIG. 8, the first structure 101 in which the container body 2 is connected to the bag body 4 is prepared. In this first structure 101, the bag body 4 is in the first state.

Subsequently, the cooling jig 80 is inserted from a lower side of the first structure 101 so as to be mounted therewith. Thus, the bag body 4 is kept in the first state. Thereafter, the first structure 101 mounted with the cooling jig 80 is disposed on a stage 90 for freeze-drying.

[2] Containing Step

Figure 9:
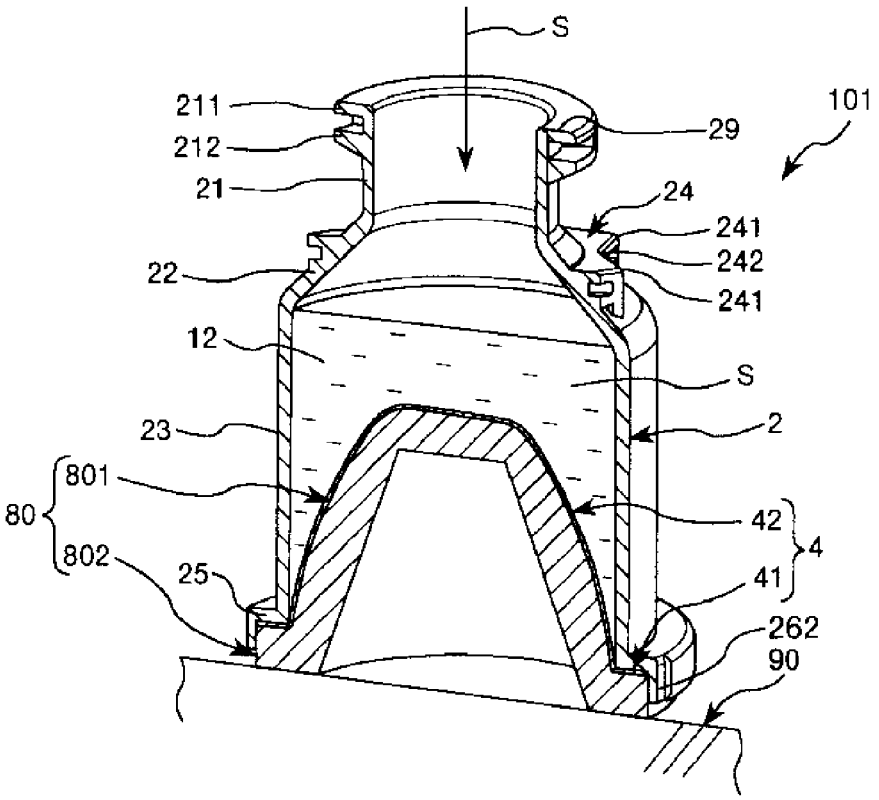
FIG. 9 is a longitudinal sectional perspective view showing the method of manufacturing the medical container according to a first exemplary embodiment of the disclosure.

Next, as shown in FIG. 9, the liquid composition S containing the medicine P is aseptically supplied to the space 12 in the first structure 101. Thus, the liquid composition S is contained in the space 12.

[3] Plugging Step

Figure 10:
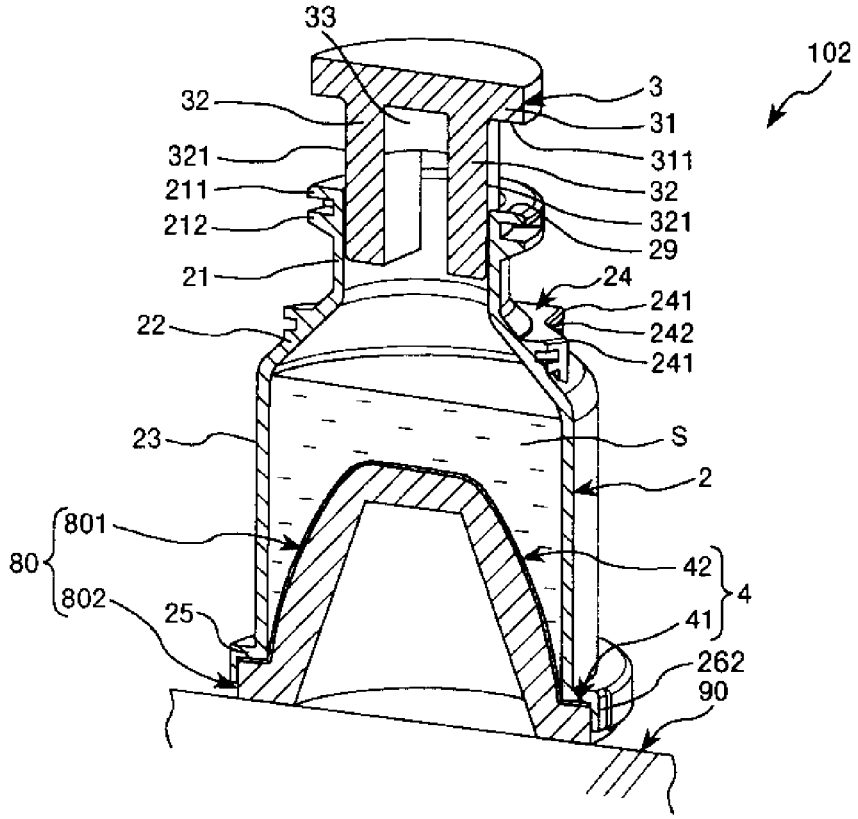
FIG. 10 is a longitudinal sectional perspective view showing the method of manufacturing the medical container according to a first exemplary embodiment of the disclosure.

Subsequently, the plug body 3 is prepared as shown in FIG. 10, and inserted into the mouth section 21 of the container body 2, whereby the first structure 101 is changed to a second structure 102.

The plug body 3 is inserted into the mouth section to the degree that the tubular section 33 of the plug body 3 is not yet inserted into the inside of the mouth section 21. With this configuration, the second structure 102 has a temporarily-plugged state in which the mouth section 21 of the container body 2 has not yet been liquid-tightly sealed with the plug body 3.

[4] Generating Step

Figure 11:
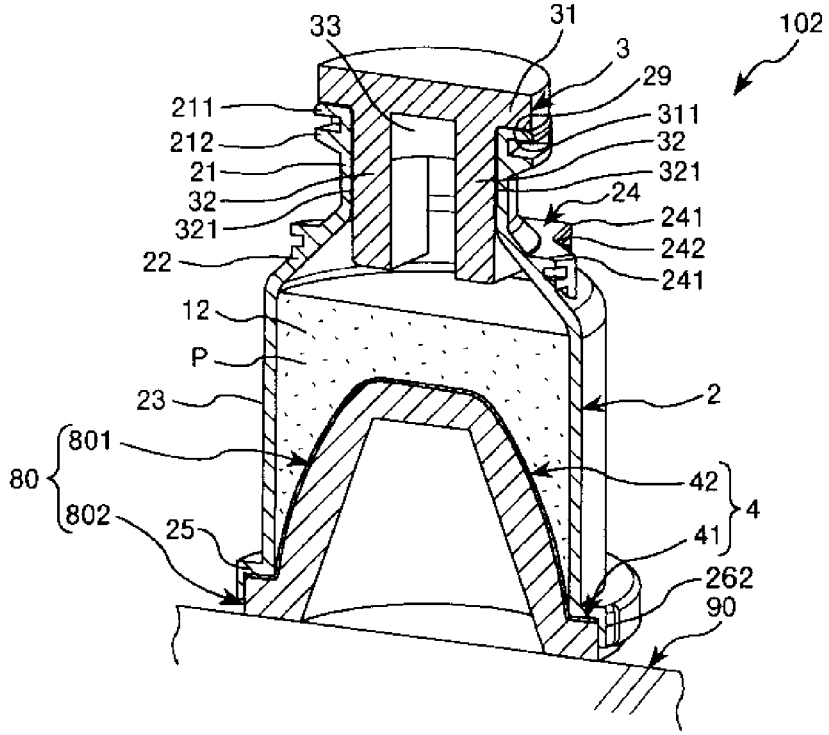
FIG. 11 is a longitudinal sectional perspective view showing the method of manufacturing the medical container according to a first exemplary embodiment of the disclosure.

Next, as shown in FIG. 11, the second structure 102 is put inside a chamber together with the stage 90 and the cooling jig 80, and then the pressure inside the chamber is decreased by a vacuum pump while the stage 90 is cooled together with the cooling jig 80. Thus, the liquid composition S is freeze-dried, and the medicine P is generated.

After that, the plug body 3 is pushed in until the proximal end surface 311 of the top plate 31 of the plug body 3 abuts on the distal end surface 29 of the container body 2. Thus, the second structure 102 obtains a plugged state in which the mouth section 21 of the container body 2 is liquid-tightly sealed with the plug body 3.

Incidentally, the cup-shaped section 801 of the cooling jig 80 contacts an entire part of the reversing part 42 of the bag body 4. With this configuration, heat can be quickly absorbed from the liquid composition S via the reversing part 42 and the cooling jig 80, thereby improving cooling efficiency. As a result, a freeze-drying time can be shortened, and the condition of crystals in the medicine P to be generated is stabilized.

In the case where the liquid composition S is contained in a container having a bottomed tube-like shape, and then freeze-dried by the stage 90 as in the prior art container, only the flat bottom portion of the container contacted the stage 90 (a contact area in this instance is referred to as "contact area a"). In contrast, according to the manufacturing method disclosed here, the cup-shaped reversing part 42 can contact the stage 90 via the cooling jig 80. As a result, the contact area of the disclosed method is increased by 1.2 to 3 times of the contact area a in the prior art. This also improves the cooling efficiency.

[5] Assembling Step

Next, the cooling jig 80 is detached from the second structure 102, and the body cap 11, the protection cover 5, the outer cover member 6, and cap 7 are assembled to the second structure 102 in appropriate order. After this assembling, the medical container 1 as shown in FIG. 1 is obtained.

Second Embodiment

The second exemplary embodiment of the medical container and a method of manufacturing the medical container according to the disclosure here will be described below with reference to the drawings. The following description will be made to center on differences from the above-mentioned embodiment, and descriptions of the same items as above will be omitted.

The second exemplary embodiment is the same as the first exemplary embodiment, except for that there are differences in configurations of respective components: a protection cover, an outside cover member, and a cap, respectively.

Figure 12:
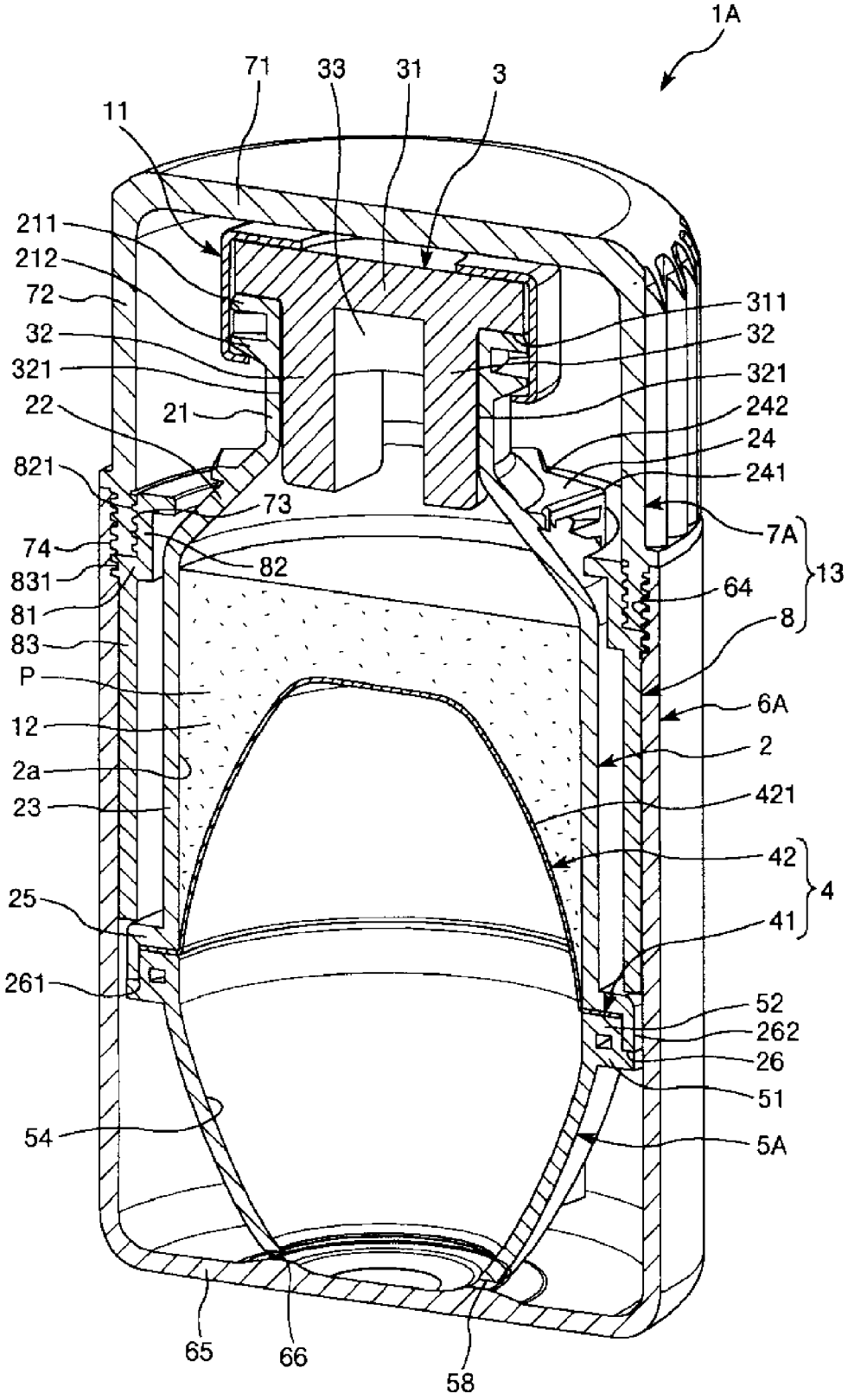
FIG. 12 is a longitudinal sectional perspective view showing a medical container (unused state) according to a second exemplary embodiment of the disclosure.
Figure 13:
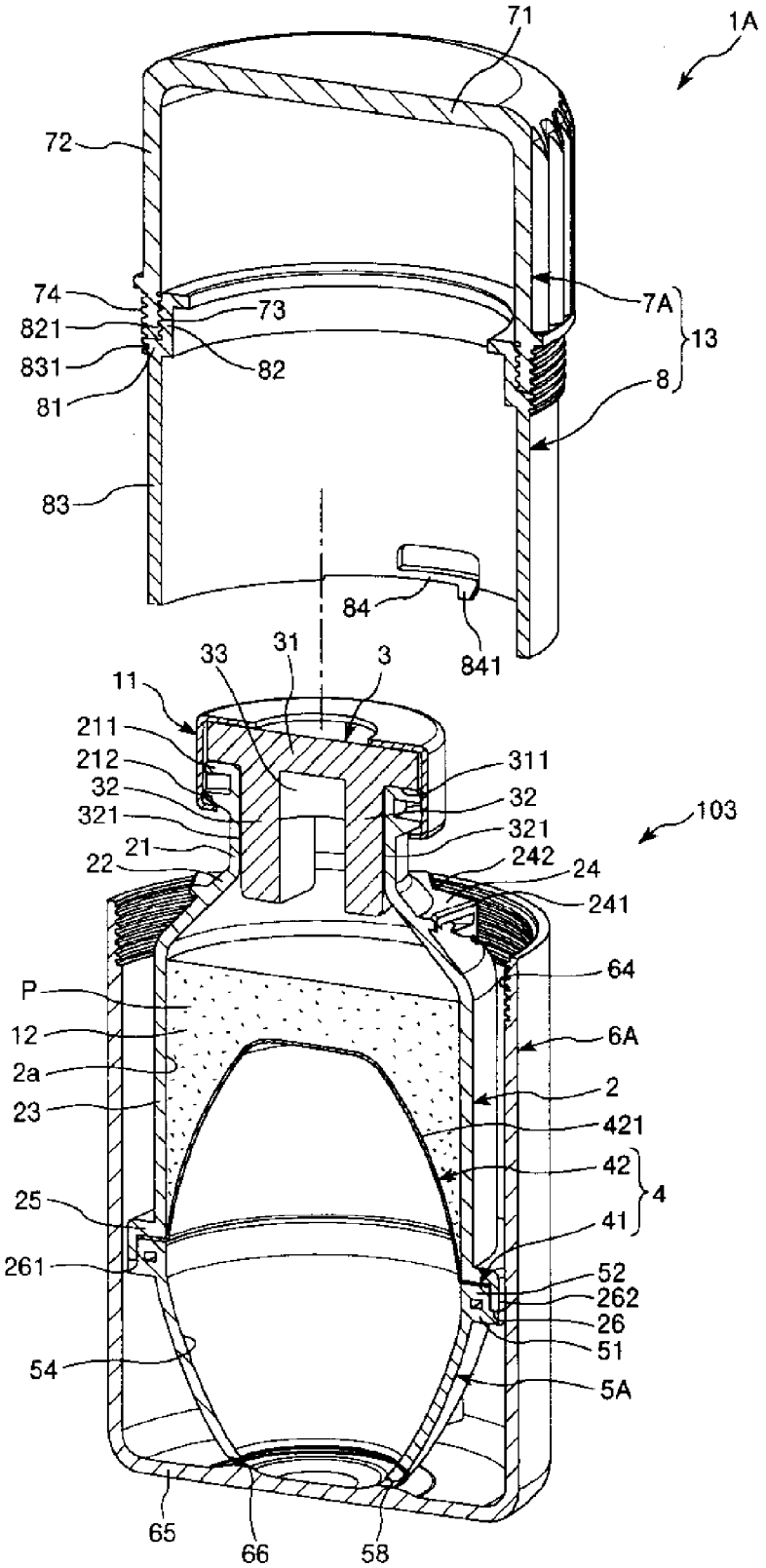
FIG. 13 is a longitudinal sectional perspective exploded view of the medical container shown in FIG. 12.

As shown in FIGS. 12 and 13, a cap assembly 13 includes a cap 7A (upper-side cap) and a lower-side cap 8 in medical container 1A.

The cap 7A includes a female screw 73 formed on a proximal-end inner peripheral surface, and a male screw 74 formed on the other side of the female screw 73, namely, on a proximal-end outer peripheral surface.

The lower-side cap 8 is formed of a cylindrical body with both of its ends opened. A stepped section 81 is formed on the distal end portion of the lower-side cap 8 such that a step is formed by a thickness of a wall section 72 of the cap 7A. The lower-side cap 8 is divided into a diameter-reduced section 82 on the distal end side and a larger-diameter section 83 on the proximal end side, thereby interposing the stepped section 81 therebetween. Further, a male screw 821 is formed on the outer peripheral portion of the diameter-reduced section 82 near the stepped section 81. A male screw 831 is formed on the outer peripheral portion of the larger-diameter section 83 also near the stepped section 81.

The female screw 73 of the cap 7A can be screw-engaged with the male screw 821 of the lower-side cap 8. Thus, the cap 7A and the lower-side cap 8 can be assembled, which is an assembled state, to form the cap assembly 13. In the cap assembly 13 in this assembled state, a continuous male screw including the male screw 74 of the cap 7A and the male screw 831 of the lower-side cap 8 is formed.

Figure 14:
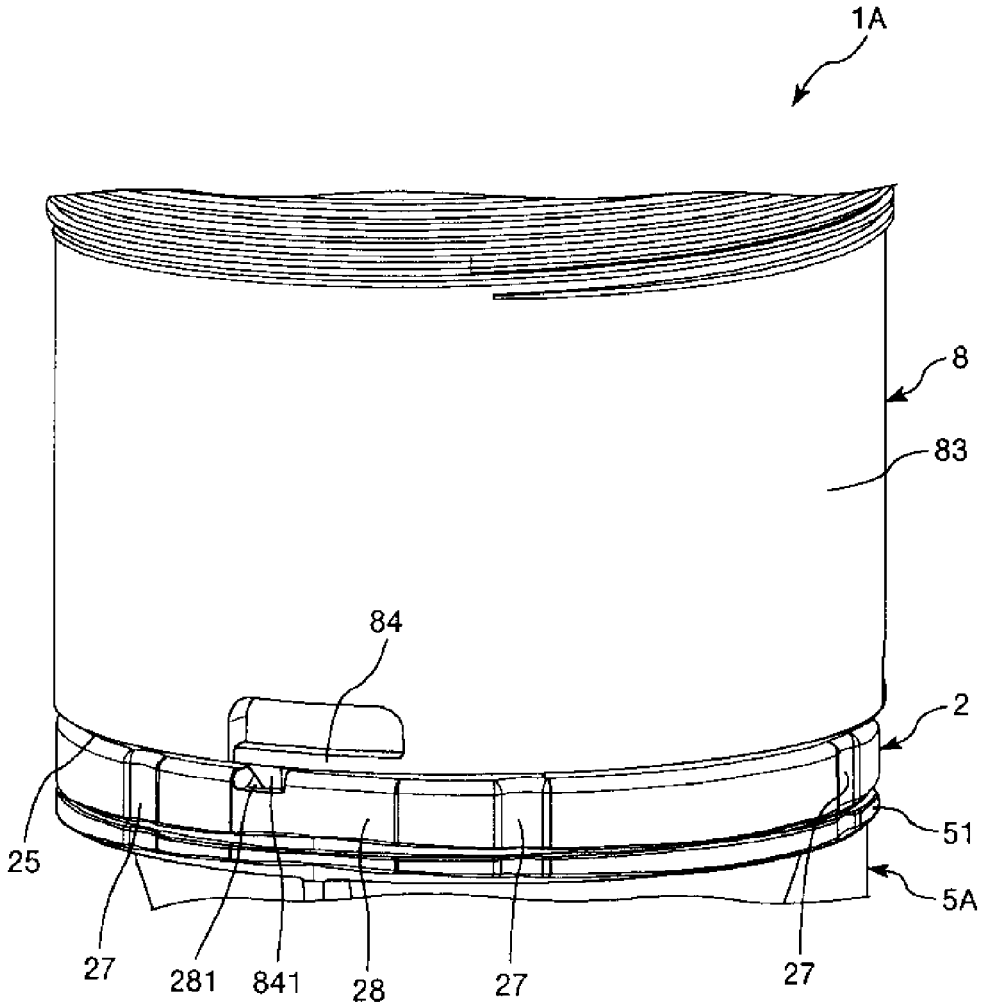
FIG. 14 is a perspective view showing a state in which a cap assembly is engaged with a container body in the medical container shown in FIG. 12.

As shown in FIGS. 13 and 14, a plurality of engagement pieces 84 (three pieces in the exemplary embodiment) that can be engaged with the container body 2 is provided at the proximal end section of the larger-diameter section 83 of the lower-side cap 8. Each of the engagement pieces 84 is elastically deformable. Further, a pawl 841 projected toward the proximal end side is formed at the end section of each engagement piece 84. Correspondingly, in the container body 2, a cavity section 281 to be engaged with the pawl 841 of each engagement piece 84 is provided at a section which connects three flat sections 28 on the distal end surface of the proximal-end edge portion 25.

Figure 15:
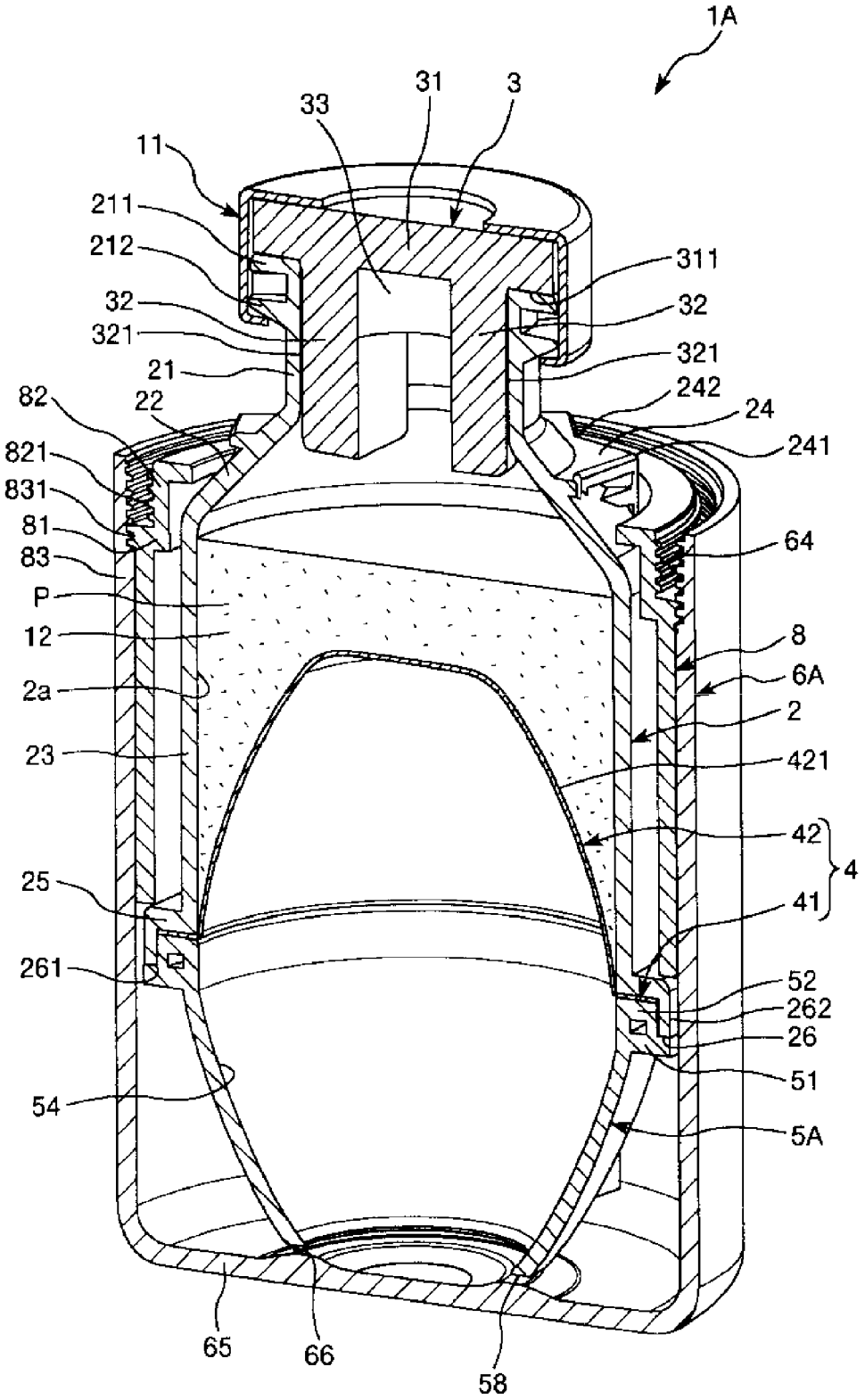
FIG. 15 is a longitudinal sectional perspective view showing a state in which the cap is disengaged from the medical container shown in FIG. 12.

As shown in FIGS. 12, 13, and 15, an outer cover member 6A is formed of a member having a bottomed tube-like shape. A female screw 64 is formed on a distal-end inner peripheral portion of this outer cover member 6A. The female screw 64 can be screw-engaged with the male screw 74 of the cap 7A and the male screw 831 of the lower-side cap 8 together in the cap assembly 13 in the assembled state (see FIG. 12).

As shown, the outer cover member 6A differs from the outer cover member 6 of the first exemplary embodiment in omitting the stepped section 67 and the rib 68.

To obtain the medical container 1A in the state shown in FIG. 12, as shown in FIG. 13, a structure 103 and the cap assembly 13 in the assembled state are prepared. The structure 103 is formed by assembling the container body 2, a plug body 3, a bag body 4, a protection cover 5A, and the outer cover member 6A. Subsequently, cap assembly 13 is inserted into the structure 103. Then, a female screw 64 of the outer cover member 6A in the structure 103 is sequentially screw-engaged with the male screw 831 of the lower-side cap 8 of the cap assembly 13 and the male screw 74 of the cap 7A. With this screw-engagement, each of the engagement pieces 84 of the lower-side cap 8 is pressed by the proximal-end edge portion 25 of the container body 2 and bent toward the distal end side. However, when the pawl 841 reaches the cavity section 281 at the proximal-end edge portion 25, the pressing force from the proximal-end edge portion 25 is released. Then, the pawl 841 is engaged with the cavity section 281.

With the above-described assembling work, the medical container 1A can be obtained. In this medical container 1A, the container body 2 and the outer cover member 6A are connected and fixed via the lower-side cap 8. Further, when the cap 7A is rotated to be detached, the rotational force is transmitted to the lower-side cap 8. However, since the lower-side cap 8 is engaged with the cavity section 281 of the container body 2 by the engagement pieces 84 as described above, the lower-side cap 8 does not rotate and only the cap 7A is detached. After that, the medical container 1A can be operated in the same manner as the first described exemplary embodiment.

The ribs 68, same as the rib on the inner peripheral surface of the outer cover member 6 of the first embodiment, may be formed on an inner peripheral surface of the lower-side cap 8. This may suppress the container body 2 from being loose in a radial direction thereof inside the lower-side cap 8.

Also, as shown in FIGS. 12, 13 and 15, the protection cover 5A is formed of a cylindrical body with both of its ends opened, in the medical container 1A. A proximal end surface 58 of the protection cover 5A is separated from a bottom portion 65 of the outer cover member 6A. Air can enter and exit the protection cover 5A via a gap 66 between the proximal end surface 58 of the protection cover 5A and the bottom portion 65 of the outer cover member 6A. With this configuration, when a reversing part 42 of the bag body 4 is changed to a second state from a first state, the air is pushed out, and vice versa, the air is suctioned. As a result, the reversing part 42 can be easily and reliably reversed.

Figure 16:
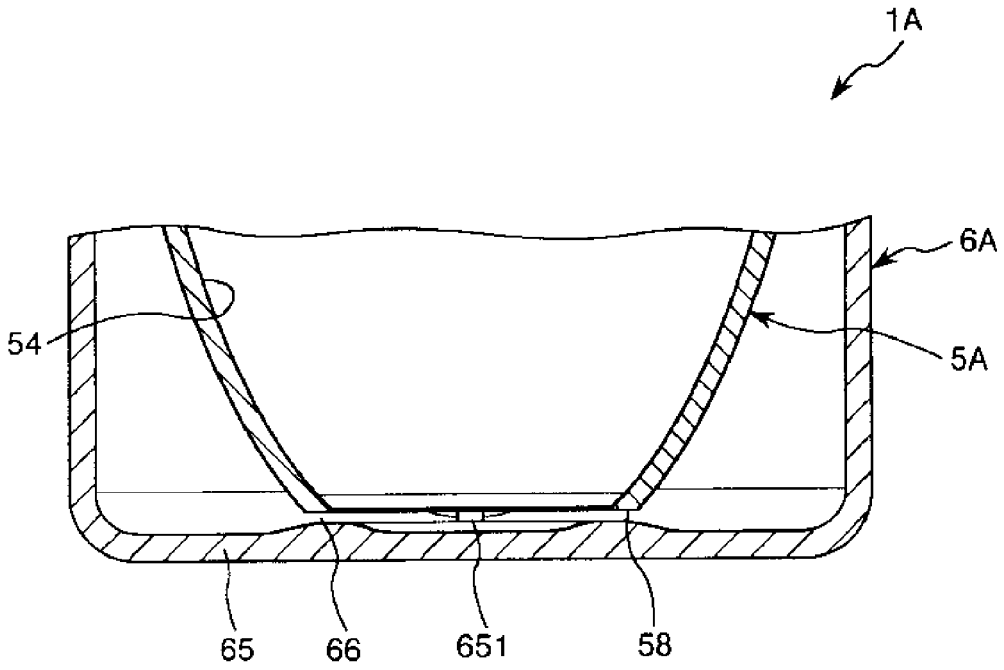
FIG. 16 is a longitudinal sectional view showing the vicinity of a proximal end section of the medical container shown in FIG. 12.

As shown in FIG. 16, a plurality of projected sections 651 (for example, three projected sections) which abuts on the proximal end surface 58 of the protection cover 5A is projected from the bottom portion 65 of the outer cover member 6A in a distal end direction. Each of the projected sections 651 abuts on the proximal end surface 58 of the protection cover 5A. As a result, the size of the gap 66 (gap length) is restricted, and the gap 66 can be reliably secured.

While the medical container and the method of manufacturing the medical container according to the exemplary embodiments of the disclosure shown in the attached drawings have been described above, the disclosure herein is not restricted to these embodiments, and each of the components of the medical container can be replaced with a constituent element that can exhibit an equivalent function. Further, arbitrary constituent elements may be added.

In addition, the medical container and the method of manufacturing the medical container according to the disclosure herein may be one that is obtained by combining arbitrary two or more constituent elements (characteristic features) of the above-described exemplary embodiments.

The medical container according to an exemplary embodiment of the disclosure includes: a tube body having a tube-like shape and including an inner peripheral portion inside thereof, a mouth section through which liquid can enter and exit a distal end portion, a proximal-end opening at a proximal end section, and a proximal-end edge portion surrounding the proximal end opening; a plug body that seals the mouth section; a bag body having a bag-like shape and including an edge portion which is tightly fixed to the proximal-end edge portion and seals the proximal end opening, and a reversing part which is surrounded by the edge portion, has flexibility and is reversed inside/outside; and a space surrounded by the tube body, the plug body, and the bag body. When the liquid enters and exits through the mouth section, the reversing part is reversed inside/outside, whereby the reversing part may take a first state and a second state. In the first state, the reversing part expands toward a distal end side, and in the second state, the reversing part expands toward a proximal end side. In both the first state and the second state, the reversing part is separated or spaced from the inner peripheral portion of the tube body.

Therefore, the reversing part is in the first state and separated or spaced from the inner peripheral portion of the container body at the time of collecting the liquid filled inside the tube body. Accordingly, a gap is formed between the reversing part and the inner peripheral portion of the container body. With this configuration, the liquid can reliably flow down to the mouth section of the tube body through the gap. As a result, a prescribed amount of the liquid can be sufficiently, easily and reliably collected.

Therefore, the medical container according to the disclosure has industrial applicability.

The detailed description above describes a medical container and method of manufacturing the same disclosed by way of example. The invention is not limited, however, to the precise embodiments and variations described. Various changes, modifications and equivalents can be effected by one skilled in the art without departing from the spirit and scope of the invention as defined in the accompanying claims. It is expressly intended that all such changes, modifications and equivalents which fall within the scope of the claims are embraced by the claims.

What is claimed is:

1. A medical container, comprising:

a tube body having a tubular shape and including an inner peripheral portion inside the tube body, a mouth section through which liquid can enter and exit a distal end portion, a proximal-end opening at a proximal end section, and a proximal-end edge portion surrounding the proximal end opening;

a plug body that seals the mouth section;

a bag body that has a bag-like shape and includes an edge portion which is tightly fixed to the proximal-end edge portion and seals the proximal end opening, and a reversing part which is surrounded by the edge portion, has flexibility, and is reversible inside/outside; and a space surrounded by the tube body, the plug body, and the bag body;

wherein the reversing part is reversed inside/outside when the liquid enters and exits the space through the mouth section, by which the reversing part can take a first state in which the reversing part expands toward a distal end side, and a second state in which the reversing part expands toward the proximal end side, and in both the first state and the second state, the reversing part is separated from the inner peripheral portion of the tube body; and wherein the reversing part is reversed inside when the liquid exits the space through the mouth section by suction with a syringe.

2. The medical container according to claim 1, wherein, in the first state, a separation distance between the reversing part and the inner peripheral portion of the tube body gradually increases in a direction away from the edge portion along an axial direction of the tube body.

3. The medical container according to claim 1, wherein a center portion of the reversing part on the other side of the edge portion has a flat shape in both the first state and second state.

4. The medical container according to claim 1, wherein the space is preliminarily filled with a medicine when the reversing part is in the first state, and the medicine partly contacts at least a proximal end side portion of a space-side surface of the reversing part when the reversing part is in the first state.

5. The medical container according to claim 1, further comprising a protection cover which is mounted on a proximal end section of the tube body and covers the reversing part from the proximal end side thereof.

6. The medical container according to claim 5, wherein the protection cover includes a vent hole through which air enters and exits the protection cover.

7. The medical container according to claim 1, wherein a syringe filled with liquid can be connected to the mouth section via a connector, and the tube body includes a rotation preventing means which prevents the connector from rotating about the axis of the tube body when the connector is connected to the mouth section.

8. The medical container according to claim 1, wherein a shape of the tube body differs from a shape of the bag body.

9. The medical container according to claim 8, wherein the tube body includes a first part having a constant radius and a second part having a radius that becomes gradually smaller toward the mouth section, and the bag body includes a part having a radius that becomes gradually smaller.

10. The medical container according to claim 9, wherein, when the reversing part is reversed inside, a top portion of the bag body is in the first part of the tube body.

11. A medical container for containing a powdery or liquid medicine comprising:

a container body including a mouth section, a proximal-end opening at a proximal end section, and a proximal-end edge portion surrounding the proximal end opening a plug body mounted on the mouth section of the container body;

a bag body including an edge portion and a reversing part, the edge portion being tightly fixed to the proximal-end edge portion of the container body; and a cap for covering the mouth section of the container body and the plug body;

wherein a space for containing the powdery or liquid medicine is defined by the bag body, the container body and the plug body; and wherein the reversing part is reversed inside/outside when a liquid enters and exits the space through the mouth section; and wherein the reversing part is separated from an inner wall of the container body so as to define a gap therebetween, wherein the reversing part is configured to be reversed inside when the liquid exits the space through the mouth section by suction with a syringe.

12. The medical container according to claim 11, wherein the gap between the reversing part and the inner wall of the container body gradually increases in a direction away from the edge portion along an axial direction of the container body in a first state of the reversing part.

13. The medical container according to claim 11, wherein the mouth section is configured to be connected to a syringe via a connector.

14. The medical container according to claim 13, wherein the container body includes a rotation preventing means which prevents the connector from rotating about the axis of the container body when the connector is connected to the mouth section.

15. The medical container according to claim 11, wherein a shape of the container body differs from a shape of the bag body.

16. The medical container according to claim 15, wherein the container body includes a first part having a constant radius and a second part having a radius that becomes gradually smaller toward the mouth section, and the bag body includes a part having a radius that becomes gradually smaller.

17. The medical container according to claim 16, wherein, when the reversing part is reversed inside, a top portion of the bag body is in the first part of the container body.

* * * * *